United States Patent [19]

Minovitch

[11] Patent Number: 5,040,373

[45] Date of Patent: Aug. 20, 1991

[54] CONDENSING SYSTEM AND OPERATING METHOD

[76] Inventor: Michael A. Minovitch, 2832 St. George St., Apt. 6, Los Angeles, Calif. 90027

[21] Appl. No.: 427,816

[22] Filed: Oct. 27, 1989

[51] Int. Cl.[5] ..... F25B 19/00

[52] U.S. Cl. ..... 62/51.1; 62/3.1; 62/467; 505/891

[58] Field of Search ..... 62/3.1, 51.1, 467; 505/889, 891

[56] References Cited

U.S. PATENT DOCUMENTS

| | | | |
|---|---|---|---|
| 4,033,734 | 7/1977 | Steyert, Jr. et al. | 62/467 |
| 4,069,028 | 1/1978 | Brown | 505/889 |
| 4,107,935 | 8/1978 | Steyert, Jr. et al. | 62/467 |
| 4,136,525 | 1/1979 | Van Vechten | 505/891 |
| 4,457,135 | 7/1984 | Hakurraku et al. | 62/467 |
| 4,459,811 | 7/1984 | Barclay et al. | 62/467 |
| 4,464,903 | 8/1984 | Nakagome et al. | 505/891 |
| 4,507,927 | 4/1985 | Barclay | 62/467 |
| 4,532,770 | 8/1985 | Hakuraku et al. | 505/891 |
| 4,599,866 | 7/1986 | Nakagome et al. | 505/891 |
| 4,625,519 | 12/1986 | Hakuraku et al. | 505/891 |

FOREIGN PATENT DOCUMENTS

| | | | |
|---|---|---|---|
| 2511134 | 2/1983 | France | 62/3.1 |
| 811058 | 4/1981 | U.S.S.R. | 62/3.1 |
| 877262 | 10/1981 | U.S.S.R. | 62/3.1 |

*Primary Examiner*—Ronald C. Capossela
*Attorney, Agent, or Firm*—Christie, Parker & Hale

[57] ABSTRACT

A cryogenic condensing system is provided wherein the working fluid is paramagnetic and entropy reduction is accomplished by means of a magnetic field. Condensation is obtained by isentropically expanding partially compressed vapor into a thermally insulated vacuum chamber with a sufficiently large expansion ratio to supersaturate the vapor, a portion of which condenses spontaneously. That portion of the vapor which does not condense is drawn out of the condensing chamber and into the bore of a superconducting solenoid by magnetic attractive forces thereby maintaining the vacuum environment inside the chamber. The noncondensed vapor is magnetized and magnetically compressed inside the solenoid thereby reducing its entropy. Heat of magnetization is extracted by a non-magnetic turbine which converts the kinetic energy of the gas stream pulled into the solenoid into mechanical work. The low entropy vapor is removed from the solenoid by a compressor mounted inside the bore such that its thermodynamic state is returned to the preexpanded state outside the magnetic field. This vapor is mixed with previously condensed vapor having the same thermodynamic state and recycled back through the condensing expander to produce a constant flow of condensed working fluid. The system could be used for cryogenic engines using oxygen.

60 Claims, 8 Drawing Sheets

CONDENSING SYSTEM AND OPERATING METHOD

BACKGROUND

In classical thermodynamics the most efficient closed cycle heat engine is known as the "Carnot engine" operating on the reversible "Carnot cycle". If $T_h$ and $T_l$ denote the temperatures of the high and low temperature heat reservoirs respectively of a Carnot engine, the theoretical output work W is given by $$W = Q\left(\frac{T_h - T_l}{t_h}\right)$$

where Q denotes the input thermal energy taken from the high temperature heat reservoir. The most efficient cooling system (i.e., refrigerator) is known as a "Carnot refrigerator". It is simply a Carnot engine operating in reverse. In this case Q, in the above equation, represents the amount of heat taken from the low temperature reservoir and transferred to the high temperature reservoir, and W represents the amount of input work required to achieve the transfer. For refrigerators, $t_l$ and $t_h$ are reversed in the above equation.

The natural environment at ambient temperature plays a key role in cyclic heat engines and refrigerators that operate by subjecting their working fluids to purely thermodynamic processes within the theoretical framework of thermodynamics. It represents a temperature zone which divides the operating temperature regimes of cyclic heat engines and refrigerators. This is because the environment at ambient temperature represents the low temperature heat reservoir for cyclic heat engines which operate by absorbing heat energy from a high temperature reservoir above ambient temperature and generating mechanical work, while in refrigerators it represents the high temperature heat reservoir which operate by absorbing heat energy from a low temperature reservoir below ambient temperature and consuming mechanical work.

The reason why closed cycle condensing heat engines are forced to operate above ambient temperature is because according to the principles of thermodynamics there is only one possible method for reducing the entropy of the working fluid required for a condensing system so that the engine can be operated cyclically. This method involves extracting heat energy from the working fluid inside the condenser and transferring it to a heat sink that is at a lower temperature. The natural environment at ambinet temperature is utilized as this heat sink and represents the low temperature heat reservoir. Since it is impossible to reduce the entropy of a working fluid without the usual method of heat transfer to a heat sink by thermodynamic processes, all prior art closed-cycle condensing heat engines operating under purely thermodynamic principles and processes must operate above ambient temperature.

There is one type of heat engine that can be operated below ambient temperature that is capable of producing both mechanical work and refrigeration. This engine is a "cryogenic engine". In this engine liquefied working fluid at cryogenic temperature (such as liquefied nitrogen at 77° K. which is the usual working fluid in cryogenic engines) is compressed to very high pressure (e.g., 300 Bar) by a hydraulic compressor and fed through a plurality of serially connected heat exchangers maintained in thermal contact with the natural environment at ambient temperature, and a like plurality of expanders interposed between adjacent heat exchangers. The high pressure liquefied working fluid entering the first heat exchanger creates a significant temperature gradient across the thermal surfaces and a large amount of natural heat energy is extracted from the environment at ambient temperature and rapidly absorbed by the circulating working fluid at cryogenic temperature. This produces a strong refrigeration effect. The liquefied working fluid is isobarically heated above its critical temperature (126.3° K. in the case of nitrogen working fluid) and completely vaporized into a super high pressure gas.

The cryogenic working fluid emerges from the first heat exchanger as a super high pressure, superheated gas at about ambient temperature. It is then fed into the first isentropic expander where heat energy taken from the natural environment in the first heat exchanger is converted into mechanical work. The pressure ratio of the first expander is such that the outlet pressure of the expanded gas leaving the expander is still fairly high. Thus, since the expansion process reduces the temperature of the exhaust gas significantly below ambient temperature, it is fed into another ambinet heat exchanger that is also maintained in thermal contact with the natural environment in order to extract still more natural thermal energy thereby providing additional refrigeration. After this second isobaric heating process, the pressurized gas is withdrawn from the second ambient heat exchanger at about ambient temperature and fed into a second isentropic expander where natural thermal energy extracted from the environment while circulating through the second heat exchanger is converted into additional mechanical work. This process of absorbing natural thermal energy from the environment and converting it into mechanical work while simultaneously providing refrigeration is continued until the exhaust pressure of the gas emerging from the last expander is equal to atmospheric pressure whereupon the gas is discharged into the open atmosphere. The operating details of this cryogenic engine can be found in U.S. Pat. No. 3,451,342 filed Oct. 24, 1965 by E. H. Schwartzman entitled "Cryogenic Engine Systems and Method".

Although this heat engine operates below ambient temperature of the natural environment and generates both mechanical work and refrigeration, it is not a cyclic heat engine. When the supply of liquefied working fluid at cryogenic temperature is consumed, the engine (and refrigerator) stops operating. Since the engine operates by strictly thermodynamic processes according to the principles of thermodynamics, the expanded working fluid cannot be recondensed into a liquid at cryogenic temperature because there is no natural heat sink available at cryogenic temperature to absorb heat energy. Thus, there is no thermodynamic method that can be used to reduce its entropy in order to enable the engine to operate cyclically. However, there is a non-thermodynamic method that can be used to reduce the entropy of the working fluid of a heat engine without having to transfer heat energy to a heat sink if the working fluid is paramagnetic. This method represents the underlying operating principle of the present invention disclosed herein.

It follows from the Carnot equation for refrigerators that when $T_l \rightarrow 0$, the required input work $W \rightarrow \infty$. Thus, it is a physical impossibility to achieve temperatures below approximately 0.4° K. by using strictly thermodynamic processes. For many years this temperature (0.4° K.) was believed to represent a "temperature barrier" which could not be broken because of basic laws of thermodynamics. However, in 1926 Debye proposed using an electromagnetic process that is outside the theoretical framework of classical thermodynamics (i.e., that is not a thermodynamic process) to break this thermodynamic barrier and achieve temperatures that are many orders of magnitude below 0.4° K. This process is called "adiabatic demagnetization" or "magnetic cooling". Basically, this process involves subjecting a paramagnetic material at low temperature (usually a solid paramagnetic salt) to a very intense magnetic field thereby heating the material while the entropy remains constant. When the heat of magnetization is extracted by a cryogenic heat sink (e.g., liquid helium at 1° K.) the entropy of the magnetized material decreases. By thermally isolating the material and removing the magnetic field, the entropy of the material remains constant but the temperature will fall way below that of the heat sink. By using this non-thermodynamic electromagnetic process (known as the "magneto-caloric effect"), temperatures as low as 0.0001° K. are possible.

It is important to point out and emphasize that when electromagnetic processes, such as the magneto-caloric effect, are used in conjunction with thermodynamic processes, the results can no longer be predicted within the theoretical framework of classical thermodynamics. For example, when subjecting a paramagnetic substance to a magnetic field, the temperature of the substance increases but its entropy (i.e., the degree of random molecular motion) remains constant due to magnetic alignment. This is thermodynamically impossible. According to thermodynamics, a substance that is heated always results in an increase in entropy. This illustrates the fact that thermodynamic principles cannot be applied to non-thermodynamic processes. (See, "Classical Physics Gives Neither Diamagnetism nor Paramagnetism," Section 34-6, page 34-8, in *The Feynman Lectures On Physics*, by R. Feynman, Addison-Wesley Pub. Co., 1964.)

The object of the present invention is to utilize the magneto-caloric effect to provide a condensing system that does not require a low temperature heat sink. Such a system could be used to construct closed-cycle condensing cryogenic engines that could be used to produce both mechanical work and refrigeration.

A recent technical development that is exploited in the design of the condensing system disclosed herein is the discovery of superconducting materials with critical temperatures above the boiling temperature of liquid nitrogen See the article, "Superconductivity Seen Above The Boiling Point of Nitrogen," *Physics Today*, April 1987, pp. 17–23 by Anil Khurana. Since cryogenic engines use these fluids (liquefield nitrogen, etc.,) at cryogenic temperature in their basic operation, this development means that it is now possible to utilize the working fluids of cryogenic engines as a cryogenic coolant for superconducting magnets instead of liquid helium which is very expensive. Since superconducting magnets generate intense magnetic fields without consuming any energy, it is possible to utilize these intense magnetic fields to construct a condensing system without requiring any external refrigeration system for the superconducting magnet. The reason why this is possible is because ordinary oxygen gas, which can be used as a working fluid in cryogenic engines, is highly paramagnetic. Since there is no cryogenic heat sink available, condensation can only be achieved by isentropically expanding low temperature vapor inside a thermally insulated condensing chamber maintained at very low pressure. However, since only a portion of the vapor can be condensed by this expansion process (via spontaneous condensation of supersaturated vapor), it is necessary to continuously remove the noncondensed portion in order to maintain the required vacuum environment inside the condensing chamber so that the condensing process can continue. By utilizing oxygen as the engine's cryogenic working fluid, this can be achieved magnetically while expending relatively little mechanical work. The high entropy noncondensed oxygen vapor can be continuously removed from the low pressure condensing chamber by means of magnetic forces generated by a superconducting solenoid. The vapor is pulled out of the chamber into the bore of the solenoid, magnetized, and magnetically compressed. Since the vapor is at cryogenic temperature, it is possible to approach paramagnetic saturation by employing a sufficiently strong magnetic field.

The magnetic forces accelerate the gas molecules moving into the magnetic field thereby increasing their kinetic energy. This increase in kinetic energy represents the heat of magnetization. By mounting a low pressure, non-magnetic rotating turbine in the accelerating gas stream, this directed magnetic kinetic energy can be extracted from the molecules, transferred to the rotating turbine and converted into mechanical work with nearly 100% conversion efficiency. The gas molecules arrive at the most intense region of the magnetic field without any significant increase in kinetic energy. Thus, the process is essentially equivalent to isothermal magnetization. A large percentage of the gas molecules will have their magnetic dipole moments aligned with the external field which results in a decrease in the entropy of the vapor. This magnetically compressed low entropy vapor is further compressed by a non-magnetic turborecompressor mounted inside the bore of the solenoid such that the vapor is forced out of the solenoid, demagnetized to a thermodynamic state identical to the preexpansion state, mixed with previously condensed vapor, and recycled back through the condensing expander to continue the condensing process. Since the entropy of the noncondensed vapor inside the solenoid is lower than it would ordinarily be without the magnetic field, the mechanical work consumed by the recompressor is reduced. Thus, the mechanical work required to maintain the vacuum environment of the condensing system is reduced. The liquefield oxygen withdrawn from the condensing system can be used to maintain the cryogenic temperature of the superconducting solenoid and utilized as the working fluid for a cyclic cryogenic engine. These are the basic physical principles and operating features of the invention disclosed herein.

BRIEF SUMMARY OF THE INVENTION

Thus, in the practice of this invention according to a presently preferred embodiment, there is provided a cryogenic condensing system and method for operating same that does not require a low temperature heat sink. This is accomplished by utilizing a working fluid that is paramagnetic and reducing the entropy by means of a magnetic field. Condensation is obtained by isentropically expanding cold, partially compressed vapor, into a thermally insulated vacuum chamber by an expansion turbine, with a sufficiently large expansion ratio to supersaturate the vapor so that a portion condenses spontaneously. That portion of the expanded vapor which does not condense is drawn out of the condensing chamber and into the bore of a superconducting solenoid by magnetic attractive forces thereby maintaining the required vacuum environment inside the chamber. This noncondensed vapor is magnetized and magnetically compressed inside the solenoid thereby reducing its entropy. The heat of magnetization of the vapor, which appears as an increase in the kinetic energy of the gas molecules resulting from being accelerated into the solenoid by magnetic attractive forces, is extracted from the vapor by a non-magnetic, low pressure, rotating turbine mounted in the accelerating gas stream. Thus, the heat of magnetization is converted directly into mechanical work thereby enabling the vapor to be magnetized isothermally. This enables the entropy of the vapor to be reduced without transferring any heat to a heat sink. The low entropy vapor is removed from the solenoid by a non-magnetic recompression turbine mounted inside the bore such that the thermodynamic state of the vapor is returned to the preexpanded state outside the magnetic field. The vapor is mixed with previously condensed vapor having the same thermodynamic state and recycled back through the condensing expander so as to produce a constant flow of condensed working fluid. Since the entropy of the noncondensed vapor inside the solenoid is reduced by the magnetic field, and since the amount of noncondensed vapor is less than the amount of vapor expanded through the expansion turbine, less mechanical work is consumed by the recompression turbine thereby enabling the recompression turbine to be driven by the expansion turbine operating in tandem with the magnetic energy turbine. By using oxygen as a working fluid which is strongly paramagnetic at cryogenic temperatures, the system can be used to construct closed-cycle condensing cryogenic engines. The condensed oxygen working fluid generated by the condensing system is used as a cryogenic refrigerant for maintaining the cryogenic temperature of the superconducting solenoid.

DRAWINGS

These and other advantages and features of the present invention will be apparent from the disclosure, which includes the specification, the claims and the accompanying drawings wherein:

DESCRIPTION OF THE PREFERRED EMBODIMENT

In prior art condensing systems operating under the theoretical framework of thermodynamics, entropy reduction is always accomplished by transferring thermal energy from the working fluid to a heat sink (i.e., low temperature heat reservoir). However, there is a non-thermodynamic method that can be used to lower the entropy of the working fluid by choosing a working fluid that is paramagnetic. This can be accomplished by exposing the paramagnetic gas to an intense magnetic field and converting the resulting heat of magnetization into mechanical work by a non-magnetic rotating turbine. This will magnetize the gas by causing the magnetic dipole moments of the gas molecules to align themselves with the external field which results in a decrease in entropy. This will enable a portion of the working fluid to be condensed without transferring any thermal energy to a heat sink and without consuming any mechanical work. Although these operating principles are not possible to achieve within the theoretical framework of thermodynamics, they are possible by employing non-thermodynamic, electromagnetic processes.

Figure 1:
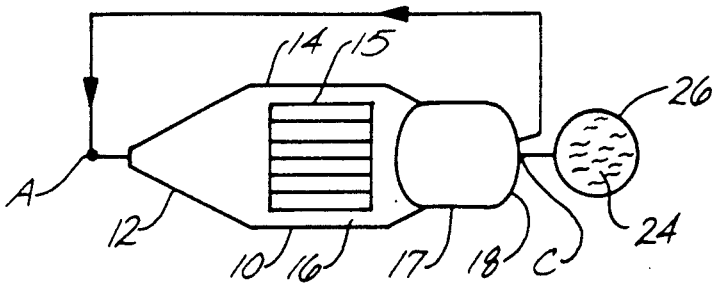
FIG. 1 is a block diagram illustrating the basic operating principles of the simplest embodiment of the condensing system.
Figure 2:
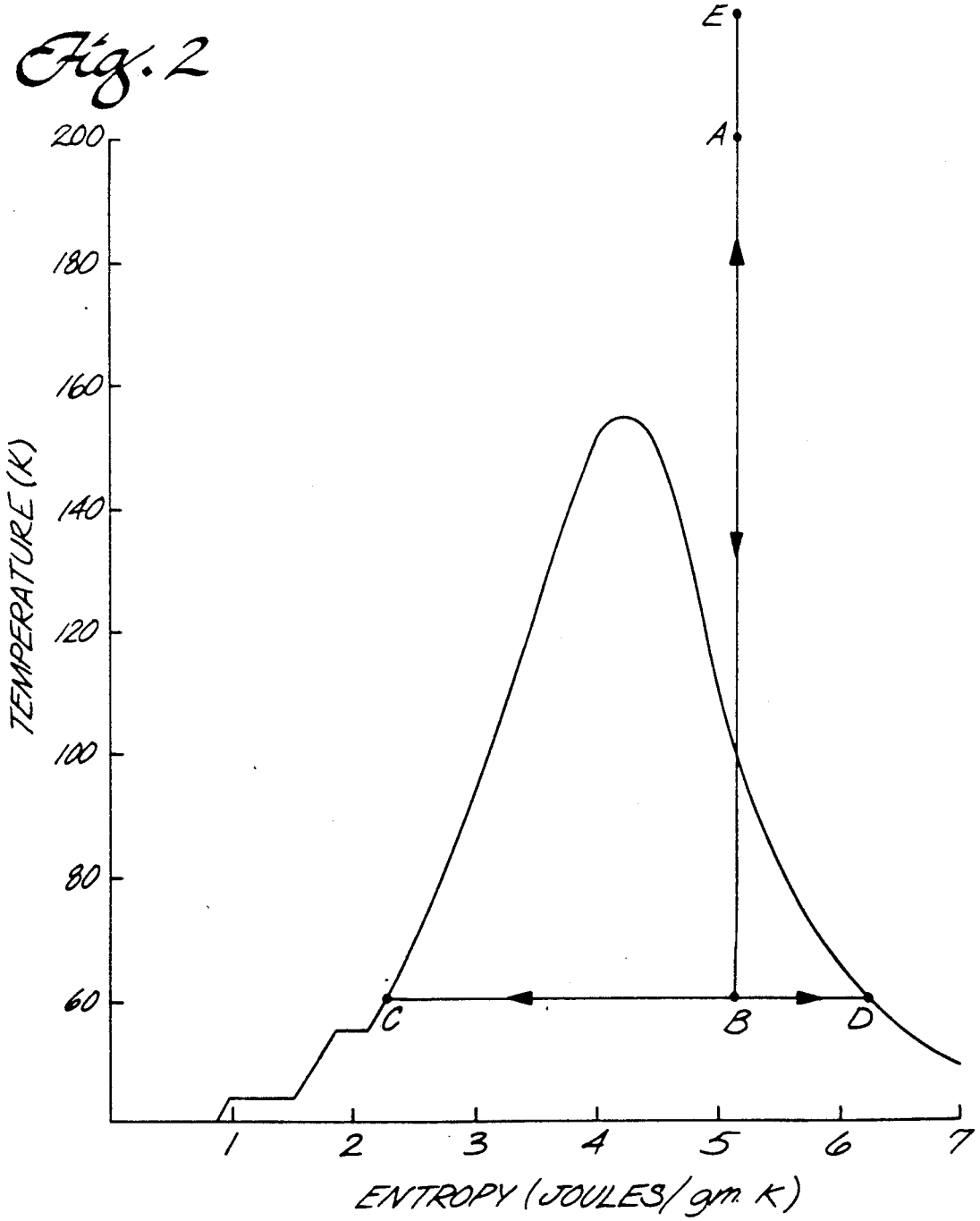
FIG. 2 is a Temperature-Entropy diagram of oxygen illustrating the basic magneto-caloric/thermodynamic operating principles of the condensing system corresponding to FIG. 1.

Since the operating principles and features of the condensing system disclosed herein are so different from prior art systems operating by purely thermodynamic processes within the theoretical framework of thermodynamics, it is important to demonstrate, at the outset, the basic operating feasibility of the invention. The simplest embodiment of the condensing system is operated according to the flow diagram shown in FIG. 1. The corresponding Temperature-Entropy diagram is shown in FIG. 2. As indicated in FIG. 1, the condensing system 10 comprises three basic subsystems. The first subsystem 12 is an evacuated thermally insulated isentropic low pressure expansion system capable of generating very large expansion ratios (on the order of 200) in order to supersaturate the vapor at cryogenic temperature. The expanded supersaturated vapor is discharged into the second subsystem 14 which is a cryogenic condensing chamber maintained at very low pressure. This subsystem 14 comprises a large plurality of condensing tubes 15 through which the metastable supersaturated vapor passes. The tubes 15 are immersed in a reservoir of previously condensed working fluid 16 and thereby maintained at cryogenic temperature. A fraction R (condensation ratio) of the metastable supersaturated vapor spontaneously condenses into the liquid phase on the inside walls while passing through the condensing tubes. Thus, the isentropic expansion system 12 reduces the partially compressed vapor to a highly supersaturated metastable vapor at cryogenic temperature such that a fraction undergoes spontaneous condensation directly into the liquid phase without having to remove any latent heat of condensation by any heat sink. The thermal energy removed from the vapor in order to bring about its liquefaction is extracted by the expansion system 12 and converted into mechanical work. This heat extraction and liquefaction process (via isentropic expansion) is well known in the prior art and is used in the liquefaction of air.

If the initial temperature and entropy of the preexpanded vapor are denoted by $T_1$ and $S(T_1)$ respectively (point A on FIG. 2), the condensation ratio R is given by $$R = \frac{S_v(T_2) - S(T_1)}{S_v(T_2) - S_l(T_2)} \quad (1)$$

where $S_l$ $(T_2)$ and $S_v$ $(T_2)$ denote the corresponding entropy on the saturated liquid and the saturated vapor curves of the working fluid corresponding to points C and D respectively. (See "Liquefaction of Gases", *Encyclopedia of Science & Technology*, McGraw-Hill, 5th Edition 1982, pp. 731-736.) The isentropic expansion process is denoted by the vertical line segment $\overline{AB}$ shown in FIG. 2. For definiteness, the working fluid is assumed to be oxygen.

That portion of the expanded vapor which condenses into the liquid phase (represented by point C on the Temperature-Entropy diagram of FIG. 2) has very low entropy and is removed from the condensing chamber 14 at point C in FIG. 1. That portion of the expanded supersaturated vapor at point B which does not condense while passing through the condensing system 14 emerges at point D with a relatively high entropy. It is removed from the condensing chamber and, in the simplest embodiment corresponding to FIG. 1, is repressurized and recycled back into the condensing expander 12 as indicated in FIG. 1. This is accomplished by the third subsystem 17. Since the condensing process described above depends upon maintaining the vacuum environment inside the condensing chamber 14, the third subsystem 17 plays a crucial role.

Instead of removing the noncondensed high entropy vapor discharged from the expansion system by conventional thermodynamic means using a mechanical recompressor, which would be very costly in terms of expending mechanical work, the vapor is removed magnetically by an intense magnetic field generated by a superconducting solenoid 18 mounted on the end of the condensing chamber 14 utilizing the unusually high natural paramagnetism of oxygen. This magnetic evacuation system represents the most important subsystem of the condensing system 10. The geometrical shape and construction of the solenoid 18 is designed such that the bore has a relatively large cross sectional area at the entrance that envelops the end of the condensing chamber 14 where the magnetic field strength is relatively low, and gradually converges to a narrow cross section where the magnetic field is most intense. The gradient of the magnetic field is designed to pull the noncondensed oxygen vapor molecules out of the condensing chamber and into the bore of the solenoid where it is magnetized and magnetically compressed. Since the oxygen vapor is at cryogenic temperature and is highly paramagnetic, it is possible for the vapor to approach paramagnetic saturation inside the bore of the solenoid by using an extremely strong magnetic field.

If the molecules are allowed to move freely from the condensing chamber into the bore of the solenoid, the magnetic forces would accelerate them to a relatively high velocity thereby increasing their kinetic energy. This increase in kinetic energy would become random where the field is most intense due to molecular collisions and the gas is magnetically compressed in the region. The enthalpy of the gas would be increased which would result in an increase in temperature. This increase in enthalpy is called "the heat of magnetization" $\Delta H_m$.

Although the magnetic field would cause a large fraction of the gas molecules to align their magnetic dipole moments with the magnetic field, there can be no reduction in entropy unless the heat of magnetization is extracted from the oxygen. In the prior art of "magnetic cooling", the magnetized substance is usually a paramagnetic salt which is solid. Thus, the only way to extract the heat of magnetization is by transferring this heat energy to a cryogenic heat sink such as liquid helium. However, in the system disclosed herein, the paramagnetic substance is a gas. The heat of magnetization can therefore be extracted from the oxygen and converted into mechanical work by a low pressure, nonmagnetic rotating turbine mounted in the accelerating gas stream where the kinetic energy is directed. Since low pressure turbines can be designed to operate at very high efficiency, it will be possible to convert nearly 100% of the directed magnetic kinetic energy of the gas (heat of magnetization) into mechanical work. With this heat extraction technique, the gas molecules will arrive at the most intense region of the magnetic field without any significant increase in kinetic energy. The temperature remains essentially constant, equal to $T_2$. Thus, the process will be essentially equivalent to isothermal magnetization resulting in a decrease in entropy by an amount $\Delta S$ which is equal to $S_v(T_2) - S(T_2)$. Thus, this isothermal magnetization process effectively brings the noncondensed vapor from point D back to point B on the Temperature-Entropy diagram of FIG. 2 along the line segment $\overline{DB}$. The corresponding heat of magnetization $\Delta H_m$ is equal to $\frac{1}{2}MB$ where M denotes the magnetization of the paramagnetic working fluid inside the bore of the solenoid with maximum magnetic field intensity B. Thus, the amount of specific mechanical work $W_m$ generated by the magnetic energy turbine is given by $$W_m = \tfrac{1}{2}MB \quad (2)$$

(Specific work refers to unit mass flow and is denoted by the symbol .)

The magnetically compressed low entropy vapor is removed from the superconducting solenoid by a turborecompressor having nearly zero magnetic susceptibility mounted inside the bore of the solenoid where the magnetic field is maximum. This turbocompressor isentropically increases the pressure of the magnetically compressed gas such that the vapor is driven out of the solenoid through a thermally insulated conduit from point B back to the initial point A. Unlike the initial expansion $\overline{AB}$, the path from B back to A takes place in two steps. The first step corresponds to the recompression by the turborecompressor inside the solenoid and is represented by the vertical line segment $\overline{BE}$ on the Temperature-Entropy diagram of FIG. 2. The amount of specific work consumed by the turborecompressor is denoted by $W_c$. When the paramagnetic gas leaves the magnetic field of the solenoid, it undergoes adiabatic demagnetization represented by the line segment $\overline{EA}$. Since the recompression process is isentropic, the gas is returned to point A with a thermodynamic state identical to the preexpanded state. Since point E is above point A, the specific work $W_c$ consumed by the recompressor along $\overline{BE}$ is greater than the specific work generated by the expander along $\overline{AB}$. This is because the gas leaving the solenoid has to overcome the magnetic field which consumes an amount of work equal to $\Delta H'_m = \frac{1}{2}BM'$ where M' represents the magnetization of the oxygen inside the solenoid after recompression.

The drive shaft of the magnetic energy turbine which generates mechanical work $W_m = \frac{1}{2}MB$ is connected to the drive shaft of the recompressor. Hence, since $M > M'$, the additional amount of mechanical work used by the recompressor to overcome the magnetic field of the solenoid is supplied by the magnetic energy turbine. Likewise, the drive shaft of the condensing expander is connected to the magnetic energy turbine and both operate in tandem to drive the recompression turbine.

If the magnetic field were zero, the specific work $W_c$ consumed by the recompressor would be equal to the specific work $W_e$ generated by the expander. Hence, when $B \neq 0$, $W_c = W_e + \frac{1}{2}M'B$. However, since a fraction R of the expanded vapor condenses, the fractional amount of vapor that does not condense which passes through the magnetic energy turbine and recompressor and returned to the initial point A is equal to $1-R$. Thus, the actual output work of the magnetic energy turbine is $W_m = (1-R)W_m$ and the actual work consumed by the recompressor is $W_c = (1-R)W_c$. Hence, the net amount of output work generated by the condensing system is equal to $W_{net} = W_e + W_m - W_c = W_e + \frac{1}{2}MB(1-R) - (1-R)[W_e + \frac{1}{2}M'B] = RW_e + \frac{1}{2}B(1-R)(M-M')$.

The heat of magnetization $\Delta H_m$ that is converted into mechanical work by the magnetic energy turbine comes at the expense of a slight decrease in the inductive energy of the solenoid. Most of this inductive energy is returned to the solenoid when the magnetized gas is driven out of the solenoid by the inductive coupling. However, since the temperature of the recompressed gas inside the solenoid at point E will be greater than $T_2$ (at point B), the magnetization M' of the recompressed gas will be reduced. Consequently, the amount of energy required to remove the recompressed gas from the magnetic field of the solenoid ($\frac{1}{2}M'B$) will be less than $\Delta H_m$. Thus, the amount of inductive energy returned to the solenoid by removing the magnetized gas via the inductive coupling will be less than $\Delta H_m$. The difference which is equal to $\frac{1}{2}B(1-R)(M-M')$, is made up by a small flux pump powered by the magnetic energy turbine so that the inductive energy of the solenoid remains constant. Thus, the actual net output work generated by the condensing system, wherein the inductive energy of the solenoid is maintained constant, is given by $$W_{net} = RW_e \tag{3}$$

Thus, the net amount of output work $W_{net}$ generated by the condensing system given by equation (3) is independent of the amount of mechanical work $W_m$ generated by the magnetic energy turbine. The main purpose of the magnetic energy turbine is to remove heat of magnetization so that the paramagnetic oxygen vapor can be isothermally magnetized by the supercondensing solenoid to reduce its entropy. This is one of the most important operating features in the condensing system since it allows the entropy to be reduced without transferring any heat to a heat sink.

Since the condensing system is thermally insulated from any outside heat source, all of the heat energy used to generate the condenser's output work $W_{net}$ is extracted from the working fluid and results in the liquefaction of a certain fraction R. The underlying principle which allows the condensing system to operate in this manner is based upon utlizing a working fluid that is paramagnetic and using a magnetic field to reduce its entropy instead of a heat sink.

The reduction in entropy $\Delta S$ obtained by subjecting any paramagnetic gas to a magnetic field of strength B at temperature T and extracting the resulting heat of magnetization $\Delta H_m = \frac{1}{2}MB$, is given by the equation $$T\Delta S = \tfrac{1}{2}MB \tag{4}$$

(See "The Ideal Paramagnetic Gas", Section 3.4, pp. 21-23 in *Magnetic Cooling*, Harvard University Press, Cambridge, Mass., 1954, by C. G. B. Garrett.)

In the condensing system disclosed herein, $\Delta S = S_v(T_2) - S(T_1)$. Consequently, in view of equations (1) and (4) where $T = T_2$, the condensation ratio R can be expressed by the equation $$R = \frac{MB}{2[S_v(T_2) - S_l(T_2)]T_2} \tag{5}$$

This equation establishes the basic theoretical feasibility of the condensing system.

Since the amount of condensation R is proportional to the strength of the magnetic field B, and inversely proportional to the condensing temperature $T_2$, the superconducting solenoid should be designed to generate an extremely intense field, and the condensing temperature $T_2$ of the working fluid should be as close to the triple point as possible. By constructing the solenoid with a stress bearing superconductor, and encasing it in a large block of solid fused silica fibers to provide a super strong rigid containment structure, the solenoid will be able to generate magnetic fields on the order of 100 T.

Although a 100 T magnetic field may appear to be unreasonably high, it should be pointed out that prior art superconductors have been developed and operated in the 40-50 T range several years ago. See, "Application of NbN Films To The Development Of Very High Field Superconducting Magnets," *IEEE Transactions On Magnetics*, Vol, MAG-21, No, 2, March 1985, pp.

459–462, by R. T. Kampwirth. et al. But the most important recent development that enable such high fields to be realizable is the discovery of "warm superconductors" with critical temperatures, critical fields and current densities way beyond that which were previously believed to be possible. Within a few months of this discovery, 60 T superconductors were developed and 100 T superconductors are expected to be developed in the near future. See "Superconductor Frenzy," *Popular Science*, July 1987, pp. 5497, by A. Fisher; and "Progress Towards Applications of High-Temperature Superconductivity," *Physics Today*, January 1988, pp. S47–S48, by A. P. Malozemoff. In order to contain the very high stresses generated by a 100 T solenoid, the solenoid will be mounted inside a very thick walled containment structure capable of supporting outward pressures equal to the bulk modulus of the material used in its construction. For pure fused quartz, this modulus is on the order of $10^{11}$N/m$^2$. Thus, in principle, superconducting solenoids generating magnetic fields on the order of 300 T could be supported by the containment structure.

In order to calculate an accurate value for the condensation ratio R from equation (5) where B=100 T, using oxygen as the paramagnetic working fluid, it is necessary to determine the magnetization M for oxygen in this 100 T magnetic field. The condensing temperature $T_2$ will be assumed to be 56° K. which is just above the triple point, 54.4° K. Although magnetization calculations of paramagnetic substances are usually obtained by an approximation using Curie's Law, it will be accurately obtained herein using exact equations from quantum mechanics.

Let $\mu$ denote the magnetic dipole moment of a single molecule of a paramagnetic gas. In quantum mechanics the scalar magnetic dipolemoment can be expressed as $g\sqrt{J(J+1)}\mu_o$ where g is a constant called the g-factor, J is the total angular momentum quantum number, and $\mu_o$ is a constant called the Bohr magnetron. (One Bohr magnetron is equal to $9.273\times10^{-24}$ Joules/Tesla.) For ordinary molecular oxygen ($O_2$) g=2 and J=1. Hence, $\mu=2.828\mu_o$. If the gas is in a region of space where there is no magnetic field, then the directions of the magnetic dipole moments $\mu$ of all the individual molecules have a random distribution because of thermal motion, and hence the gas as a whole, exhibits no net magnetism. However, if there is an external magnetic field, then a certain fraction f of the individual dipoles (i.e., molecules) will become aligned with the external field. The stronger the field, the greater the alignment; and the lower the gas temperature, the greater the alignment. The gas is said to have paramagnetic saturation when all of the dipoles are aligned with the magnetic field. In classical electromagnetic theory, the resulting magnetization $M_o$ corresponding to paramagnetic saturation is given by $M_o=N\mu$ where N denotes the number of molecules per unit volume (or per unit mass). In quantum mechanics however, it is impossible for all the dipoles to be aligned with the external field because of spatial quantization. Hence, in quantum mechanics, the maximum possible magnetization $M_o$ will be somewhat less than that predicted from classical electromagnetic theory. In quantum mechanics $M_o=NgJ\mu_o$. By setting N equal to Avogadro's number $6.022169\times10^{23}$ molecules/mole, and dividing by the molecular weight of oxygen 32, M is obtained in units of Joules/(gm Tesla).

In practice, it is impossible to achieve complete paramagnetic saturation. Hence, the magnetization M that results from partial alignment is given by $M=fM_o$. Omitting the details, it can be shown that $$f=\frac{M}{M_o}=\left(\frac{2J+1}{2J}\right)\coth\left[\left(\frac{2J+1}{2J}\right)a\right]-\left(\frac{1}{2J}\right)\coth\left(\frac{a}{2J}\right) \quad (6)$$

where the parameter $$a=\frac{gJ\mu_oB}{kT}$$

and k=Boltzmann's constant equal to $1.38062\times10^{-23}$ Joules/°K. The external magnetic field strength is denoted by B (Teslas). The function on the right hand side of equation (6) is called the "Brillouin" function. (See, *Modern Magnetism*, Cambridge University Press, 1963, pp. 43–44 by L. F. Bates; and "Tables of the Brillouin Function and of the Related Function for the Spontaneous Magnetization", British Journal of Applied Physics, Vol. 18, 1967, pp. 1415–1417 by M. Darby.)

When the parameter values B=100 T, g=2, J=1, and T=56° K. are substituted in equation (6), a=2.398764 and f=0.902345. Consequently, M=0.314956 Joules/(gm Tesla). The values of $S_v(T_2)=6.455$ Joules/gm°K. and $S_f(T_2)=2.147$ Joules/gm°K. (These entropy values were obtained from, *Thermodynamic And Related Properties Of Oxygen From The Triple Point to* 300° *K. At Pressures to* 1,000 *Bar*, NASA Ref. Pub. 1011, NBSIR 77-865, Dec. 1977 by L. A. Weber.) Substituting these values into equation (5) with $T_2=56°$ K. gives a condensation ratio R=0.065276. Thus, over 6.5% of the oxygen vapor entering the condensing system at point A in FIG. 1 will liquefy at point C at 56° K.

The heat of magnetization $\Delta H_m$, which can be calculated from equation (2) is 15.7478 Joules/gm. The entropy decrease $\Delta S$, which can be calculated from equation (4), is 0.2812 Joules/gm°K. Consequently, the entropy at points A and B will be equal to $S_v(T_2)-\Delta S=6.174$ Joules/gm°K. Assuming that the vapor at point A is at a pressure of 1.0 Bar, the corresponding temperature $T_1$ and enthalpy $H_1$ can be calculated from the above mentioned book by Weber. The results are $T_1=230.000°$ K. and $H_1=208.580$ Joules/gm. (In order to be consistent with the tabulated property date of oxygen given in the above mentioned book by Weber, the calculations will be carried to three significant decimal digits.) The enthalpy $H_2$ at point B after expansion will be $H_2=34.852$ Joules/gm. The pressure at point B is $P_2=0.00242$ Bar. The specific volumes at points A and B are $\overline{V}_1=596.519$ cm$^3$/gm and $\overline{V}_2=115{,}080$ cm$^3$/gm respectively. Hence, the expansion ratio $r=\overline{V}_2/\overline{V}_1=192.908$.

The output work $W_e$ generated by the condensing expansion A→B is given by $W_e=H_1-H_2=173.728$ Joules/gm. Consequently, in view of the above analysis the net output work $W_{net}$ generated by the condensing system by expanding one gram of oxygen given by equation (3) is equal to $0.065276\times173.728$ Joules=11.340 Joules.

The thermodynamic state parameters of the condensed oxygen at point C (FIG. 1) can be obtained from the above mentioned book by Weber. These parameters are: $T_3=56.000°$ K., $P_3=0.00242$ Bar, $H_3=-190.700$ Joules/gm, $S_3=2.147$ Joules/gm°K. Therefore, the total amount of thermal energy Q extracted from the oxygen by the condenseing system to bring about the liquefaction is $R(H_1-H_3)=0.065276\times(208.580+190.700)$ Joules=26.063 Joules. Since the condensing system is thermally insulated from the surroundings and does not exchange any heat energy, it follows from the principle of conservation of energy that this extracted heat energy Q (input heat to the condensing system) must be equal to the net output work $W_{net}+(1-R)\Delta H'_m$ (heat loss due to adiabatic demagnetization represented by E→A in FIG. 2)$+\frac{1}{2}(1-R)B(M-M')$ (amount of energy fed into the solenoid via the magnetic energy turbine to maintain constant inductive energy). Since $\Delta H'_m=\frac{1}{2}BM'$, it follows that $(1-R)\Delta H'_m+\frac{1}{2}(1-R)B(M-M')=\frac{1}{2}(1-R)BM'+\frac{1}{2}(1-R)B(M-M')=\frac{1}{2}(1-R)BM$. Therefore, the total amount of heat energy Q extracted from the oxygen must be equal to $W_{net}+\frac{1}{2}(1-R)BM$ which is equal to $11.340+14.920=26.060$ Joules, which is equal to Q. These calculations represent a numerical check on the underlying operating principles of the condensing system.

Figure 3:
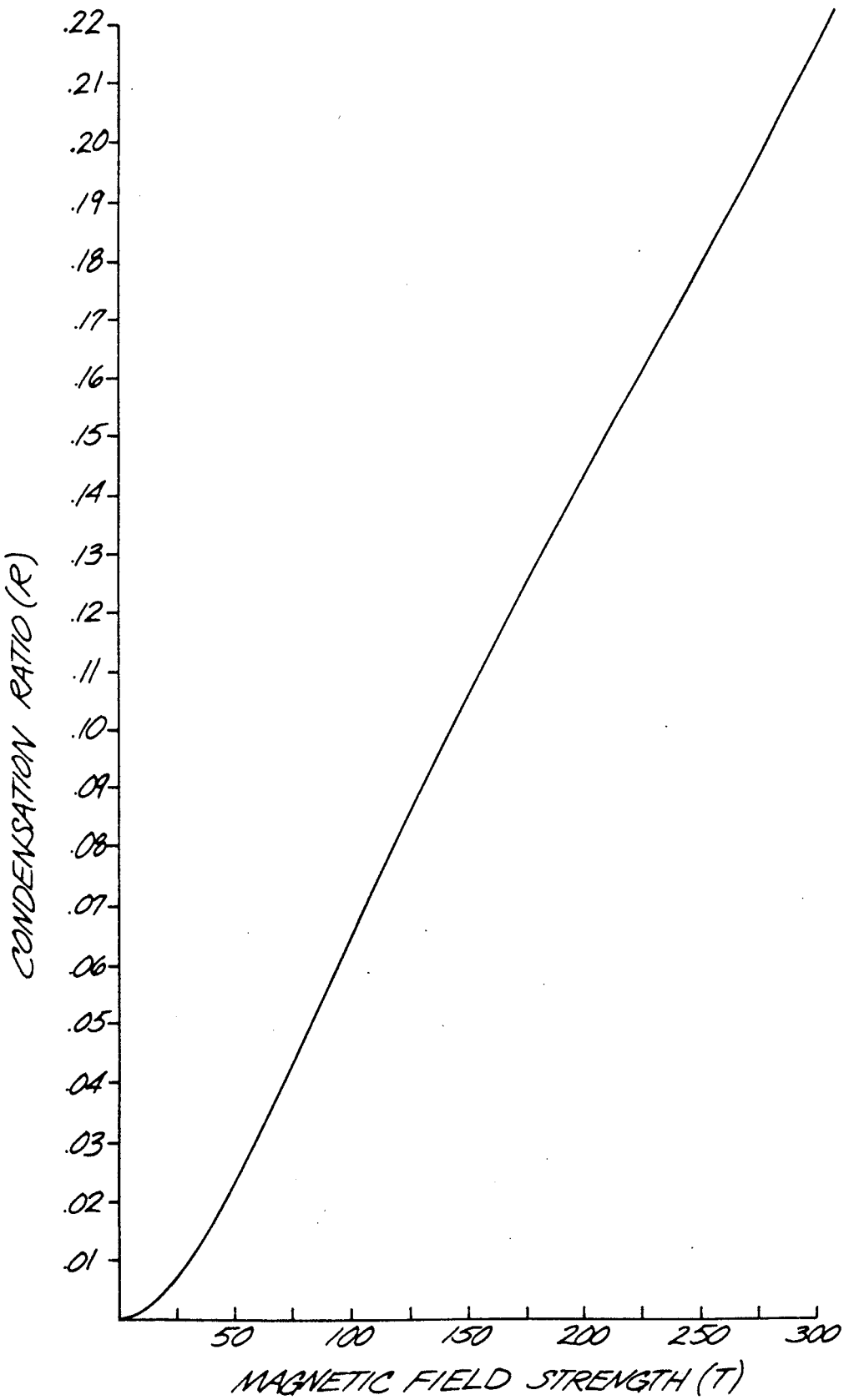
FIG. 3 is a graph of condensation ratio R versus magnetic field strength B for the condensing system.

FIG. 3 is a graph of condensation ratio R versus magnetic field strength B for a condensing system using oxygen as the paramagnetic working fluid where $T_2=56°$ K. For relatively weak magnetic fields (on the order of 10 T), the condensation ratio will be very small 0.001 (0.1%). However, for super strong magnetic fields on the order of 300 T, the condensation ratio will be over 0.22 (22%).

Since the fractional amount of vapor passing through the condensing system which condenses is constant, the condensing system has the capability of eventually condensing all of the working fluid. This can be achieved by simply accumulating all of the vapor that condenses. As illustrated in FIG. 1, the noncondensed portion is continuously recycled back through the condensing system without adding any new previously condensed vapor. Since the fractional amount of vapor that condenses remains constant, the mass flow passing through the system gradually decreases until all of the vapor is condensed. The enthalpy extracted from the vapor to bring about its condensation is converted into mechanical work by the expansion process. Although such a condenser would be impossible using purely thermodynamic processes and operating principles, it is possible by employing non-thermodynamic, electromagnetic processes.

The use of a magnetic field to reduce the entropy of a substance is not a new concept. In fact, it is over 60 years old. It is called "adiabatic demagnetization" or "magnetic cooling". (See Chapter 4, "Cooling by Adiabatic Demagnetization," pp. 99–108, in *Cryogenic Engineering*, D. Van Nostrant Co., Inc., 1959 by R. B. Scott, and the above mentioned book by Garrett.) But in the prior art, this method is used in a laboratory for lowering the temperature of a paramagnetic solid to attain temperatures near absolute zero for theoretical investigations in basic physics and not (as in this invention) for lowering the entropy of a paramagnetic gaseous working fluid in a cryogenic engine. Thus, the present invention represents a completely new and radical application of magnetic fields to cryogenic engines on an industrial scale to obtain physical changes in the working fluids, and thereby attain operating characteristics that would ordinarily be impossible using thermodynamic methods. The development of new superconductors with critical temperatures, and critical fields way beyond previously believed limits makes the invention a practical possibility.

Figure 4:
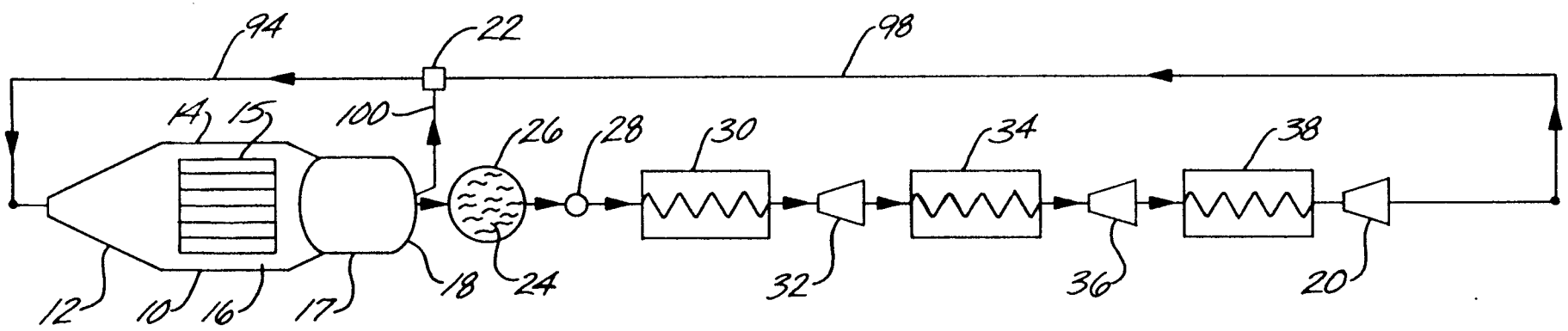
FIG. 4 is a block diagram of a cryogenic engine using the preferred embodiment of the condensing system.

In the preferred embodiment of this invention, the condensing system 10 is designed for use in a closed cycle condensing cryogenic engine using oxygen as the paramagnetic working fluid. FIG. 4 is a block diagram of the cryogenic engine illustrating the operating features of the condensing system 10. The detailed operating parameters of the condensing system are identical to those described above. A detailed thermodynamic analysis of the cryogenic engine is given to evaluate its performance when using the condensing system to obtain closed-cycle operation.

The relevant operating parameters of the condensing system are: B=100 T, expansion ratio r=192.908, condensation ratio R=0.06527, net output work $W_{net1}=11.340$ Joules/(gm expanded); initial preexpansion thermodynamic parameters $T_1=230.000°$ K., $P_1=1{,}000$ Bar, $H_1=208.580$ Joules/gm, $S_1=6.174$ Joules/gm°K., (point A FIG. 2); $T_2=56.000°$ K., $P_2=0.000242$ Bar, $H_2=34.852$ Joules/gm, $S_2=6.174$ Joules/gm°K. (point B FIG. 2); $T_3=56.000°$ K., $P_3=0.000242$ Bar, $H_3=-190.700$ Joules/gm, $S_3=2.147$ Joules/gm°K. (point C FIG. 2); $T_4=56.000°$ K., $P_4=0.000242$ Bar, $H_4=50.600$ Joules/gm, $S_4=6.455$ Joules/gm°K. (point D FIG. 2).

The liquefied oxygen emerging from the condensing system at point C is compressed to 1.000 Bar and initially utilized as a cryogenic coolant for the condensing system as described above. After this isentropic compression, the thermodynamic state parameters are: $T_5=56.003°$ K., $P_5=1.000$ Bar, $H_5=-190.620$ Joules/gm, $S_5=2.147$ Joules/gm°K. The amount of mechanical work expended in this compression is $W_{c0}=H_5-H_3=0.080$ Joules/gm.

The thermodynamic operating parameters of the cryogenic engine which uses the liquefied oxygen generated in the condensing system as its cryogenic working fluid are designed such that the vapor exhausted from the last expander 20 (FIG. 4) has a thermodynamic state equal to the initial preexpansion state for the condensing system at point A (FIG. 2). Thus, the vapor exhausted from the last expander 20, is mixed with noncondensed vapor discharged from the condensing system in a mixing vessel 22 (with the same initial thermodynamic state) and recycled back through the condensing system 10. Thus, since the condensation ratio R is constant, the mass flow through the condensing system m (gm/sec) remains constant, and the mass flow of liquefied oxygen R m generated by the condensing system remains constant.

The liquefied oxygen 24 generated in the condensing system 10 is withdrawn from the condensing system 10 and fed into a thermally insulated cryogenic reservoir vessel 26. The liquefied oxygen is withdrawn from this vessel 26 and fed into a cryogenic hydraulic compressor 28 where it is isentropically compressed to 500 Bar (493.46 Atm or 7,239 lbs/in$^2$). The compressed liquefield oxygen emerges from this compressor 28 with its thermodynamic parameters equal to: $T_6=60.222°$ K., $P_6=500$ Bar, $H_6=-152.706$ Joules/gm, $S_6=2.147$ Joules/gm°K. The work consumed by the compressor 28 is given by $W_{c1}=H_6-H_5=37.914$ Joules/gm. The compressed liquid oxygen leaves the compressor 28 and is immediately fed into the first ambient heat exchanger 30 which is maintained in thermal contact with the natural environment where it is isobarically heated. This heat exchanger 30 may be immersed in a large body of water, or positioned in a passing stream of atmospheric air. It may also be heated by direct solar radiation.

Since the temperature of the compressed liquefied oxygen entering the heat exchanger 30 is significantly below that of the medium, the thermal gradiant across its thermal surfaces is very large and thus the cryogenic oxygen extracts the natural thermal energy from the medium at a rapid rate. Therefore, the compressed oxygen is rapidly heated above its critical temperature (154.8° K.) and vaporized to become a pressurized gas which is superheated to an assumed temperature of 290° K. The pressurized superheated oxygen leaves the heat exchanger 30 with its thermodynamic state parameters equal to: $T_7=290.000°$ K., $P_7=500.000$ Bar, $H_7=193.410$ Joules/gm, $S_7=4.557$ Joules/gm°K.

Upon leaving the first heat exchanger 30 (FIG. 4) the superheated pressurized oxygen is fed into the first cascading isentropic expander 32 where a large portion of the natural thermal energy extracted from the medium inside the first heat exchanger 30 is converted into mechanical work $W_1$. It will be assumed that the outlet pressure of the first expander 32 is 40 Bar. Hence, its pressure ratio $P_7/P_8=500/40=12.5$. The thermodynamic state parameters at the outlet are: $T_8=150.244°$ K., $P_8=40.000$ Bar, $H_8=82.338$ Joules/gm, $S_8=4.557$ Joules/gm°K. The amount of mechanical work generated by the first expander 32 is equal to $W_1=H_7-H_8=111.072$ Joules/gm. This is significantly greater than the amount of mechanical work $W_{c1}$ consumed by the compressor 28 (FIG. 4).

The expanded oxygen leaving the first expander 32 at 150.244° K. is fed into the second heat exchanger 34 that is also maintained in thermal contact with the medium. The compressed oxygen at 40,000 Bar is circulated through this second heat exchanger 34 where it extracts and absorbs a considerable amount of additional thermal energy from the medium. Thus, the oxygen is isobarically reheated back to 290° K. and emerges from the second heat exchanger 34 as a superheated compressed gas. The thermodynamic state parameters of the compressed superheated oxygen are: $T_9=290.000°$ K., $P_9=40.000$ Bar, $H_9=253.420$ Joules/gm, $S_9=5.400$ Joules/gm°K.

After leaving the second ambient heat exchanger 34 the superheated pressurized oxygen is fed into the second isentropic expander 36 where a large portion of the natural thermal energy extracted and absorbed from the medium during the second heating step is converted into additional mechanical work $W_2$.

As pointed out above, the last expander 20 of the cryogenic engine is designed to discharge the oxygen with a thermodynamic state equal to the initial preexpansion state of the condensing system 10 corresponding to point A on the Temperature-Entropy diagram of FIG. 2. In order to achieve this, the inlet pressure for the third expander 20 should be equal to 1.586 Bar. Consequently, the outlet pressure of the second expander 36 must be 1.586 Bar. Therefore, the thermodynamic parameters of the oxygen discharged from the second expander 36 are: $T_{10}=112.353°$ K., $P_{10}=1.586$ Bar, $H_{10}=99.669$ Joules/gm, $S_{10}=5.400$ Joules/gm°K. The amount of mechanical work generated by the second expander 36 is equal to $W_2=H_9-H_{10}=153.751$ Joules/gm.

The expanded oxygen leaving the second expander 36 at 112.353° K. is fed into the third heat exchanger 38 that is also maintained in thermal contact with the medium. Thus, the oxygen is isobarically reheated back to 290° K. by extracting additional thermal energy from the medium and emerges from this third heat exchanger 38 as compressed gas at 1.586 Bar. The thermodynamic state parameters are: $T_{11}=290.000°$ K., $P_{11}=1.586$ Bar, $H_{11}=263.174$ Joules/gm $S_{11}=6.174$ Joules/gm°K. The oxygen is then fed into the last expander 20 where additional thermal energy extracted from the medium in the third heat exchanger 38 is converted into additional mechanical work. The thermodynamic parameters for the oxygen discharged from the third expander 20 are: $T_{12}=230.000°$ K., $P_{12}=1.000$ Bar, $H_{12}=208.580$ Joules/gm, $S_{12}=6.174$ Joules/gm°K. As required, this thermodynamic state is exactly equal to the initial thermodynamic state for the oxygen entering into the condensing system 10 represented by point A in FIG. 2.

The mechanical work generated by the third expander 20 is equal to $W_3=H_{11}-H_{12}=54.594$ Joules/gm. Thus, the total mechanical work generated by all three expanders is equal to $W=W_1+W_2+W_3=319.417$ Joules/gm. Hence, the net output work generated by the engine is $W_{net2}=W-W_{c1}=281.503$ Joules/gm. The actual net mechanical output work generated by the cryogenic engine corresponding to one gram of vapor entering the condensing system 10 is $W_{net2}=R-W_{net2}=18.374$ Joules/(gm expanded). Hence, the total net output work $W_{net}$ of the engine and condensing system is $$W_{net}=W_{net1}+W_{net2}=29.714 \text{ Joules/(gm expanded)} \quad (7)$$

The net power output $P_{net}$ corresponding to a rate of mass flow m (gm/sec) of vapor entering the condensing system at point A (FIG. 2) is given by $$P_{net}=29.714\ m\ (Watt) \quad (8)$$

Before considering any detailed structural designs it is important to point out and emphasize that, except for the condensing system, there is nothing new about the above thermodynamic calculations. The input thermal energy used to generate the mechanical output work comes from absorbing natural heat energy from the ambient environment through some exchange medium as in prior art cryogenic engines. What is new, however, is the condensing system. Since this system involves operating principles and processes that are not thermodynamic and outside the basic theoretical framework of thermodynamics, the condensing system, and therefore the engine, cannot be regarded as thermodynamic systems operating under the principles and laws of thermodynamics. Rather, the engine is a "magnetothermal" engine that is capable of operating with thermal efficiencies that are not bounded by thermodynamic principles. (Of course, basic laws of physics such as conservation of energy must be obeyed.)

In considering the practical engineering problem of constructing the condensing system according to a preferred embodiment of the invention, there is at the outset, a serious mechanical problem. The condensing expander will have to be capable of generating expansion ratios on the order of 200 in one expansion step in order to achieve the desired condensation ratios. But energy extracting, isentropic low pressure expanders capable of delivering expansion ratios of this magnitude do not exist. Thus, one of the important structural novelties of the present invention is the disclosure of a cryogenic, low pressure, work generating cold gas expander that is very nearly isentropic and capable of providing essentially unlimited expansion ratios with variable mass flow. In the preferred embodiment, this expander is a continuous flow rotating turbine.

Figure 5:
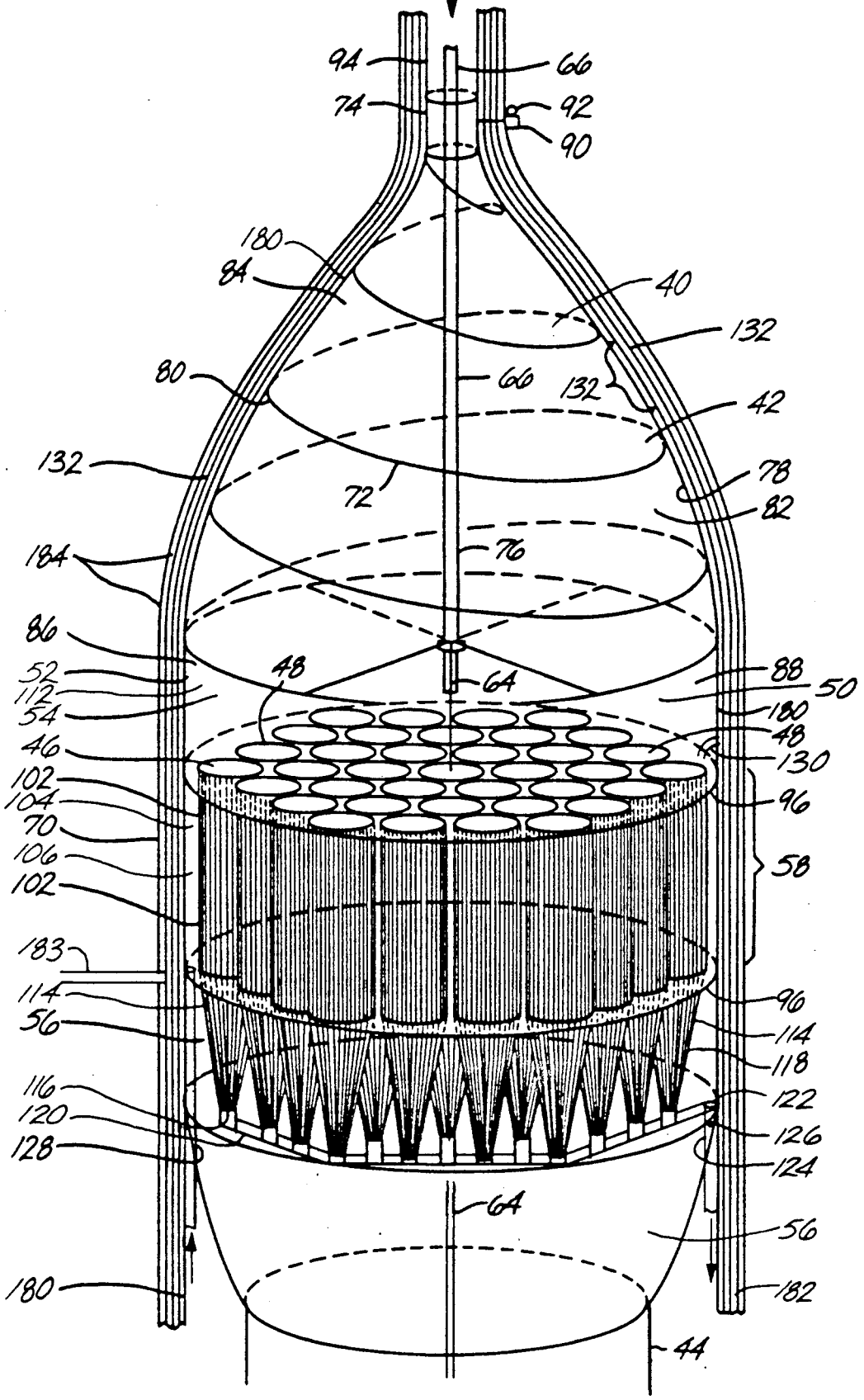
FIG. 5 is a schematic longitudinal perspective view illustrating the design, construction and operating principles of the low pressure condensing expander.
Figure 6:
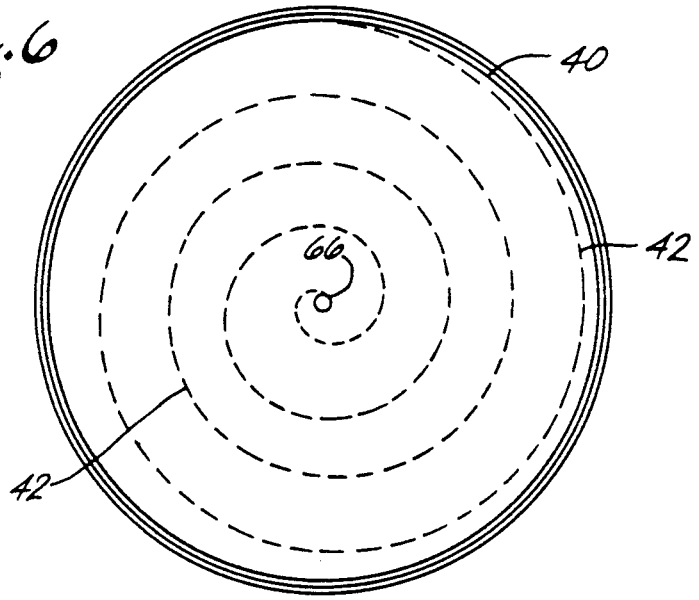
FIG. 6 is a schematic transverse cross section further illustrating the design and construction of the condensing expander and one of its spiraling expansion blades.
Figure 7:
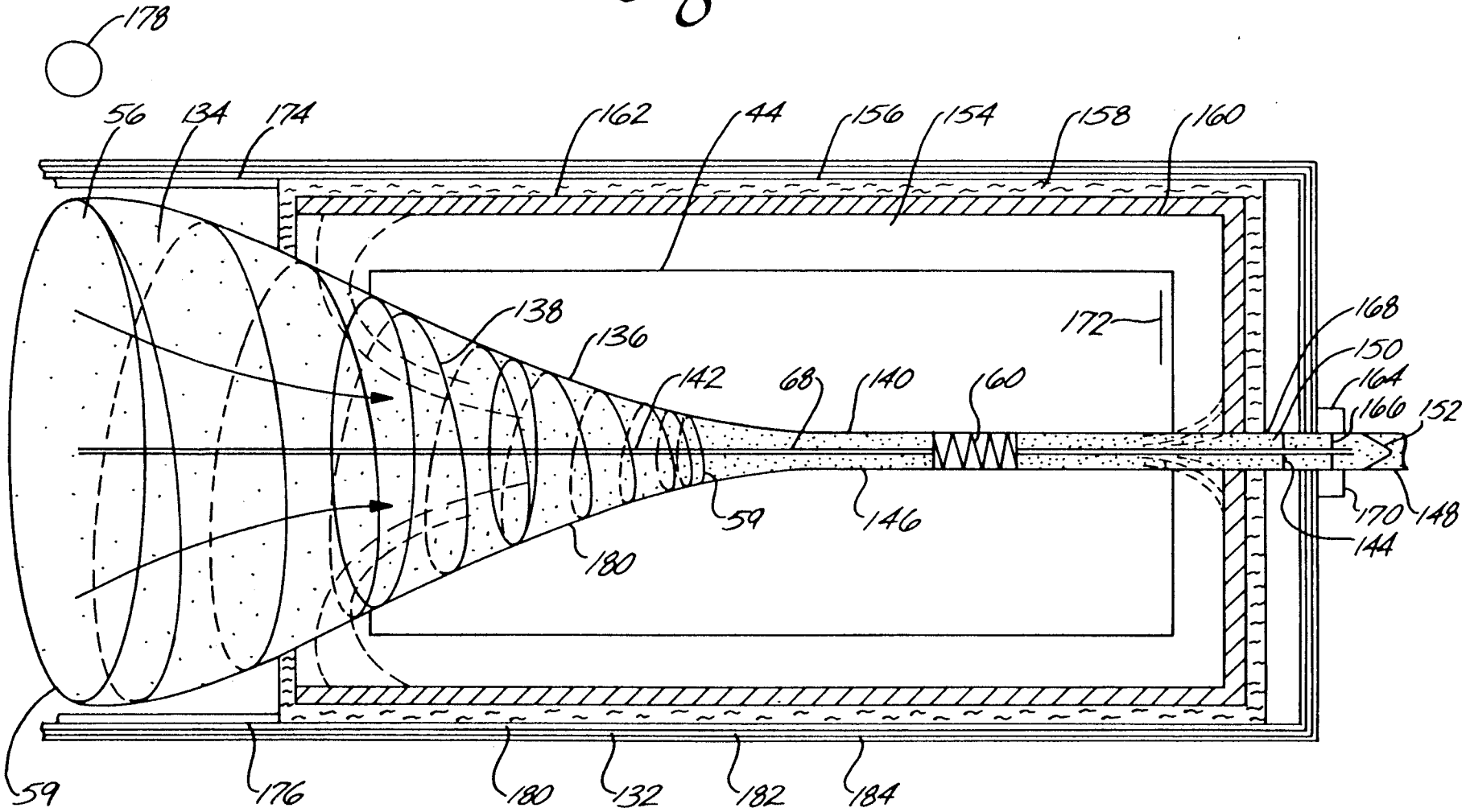
FIG. 7 is a schematic longitudinal perspective view illustrating the design and construction of the superconducting solenoid and magnetic energy turbine that is designed to removed and isothermally magnetize noncondensed oxygen vapor from the condensing chamber thereby maintaining the vacuum environment of the condensing chamber while simultaneously lowering the entropy of the noncondensed vapor.
Figure 8:
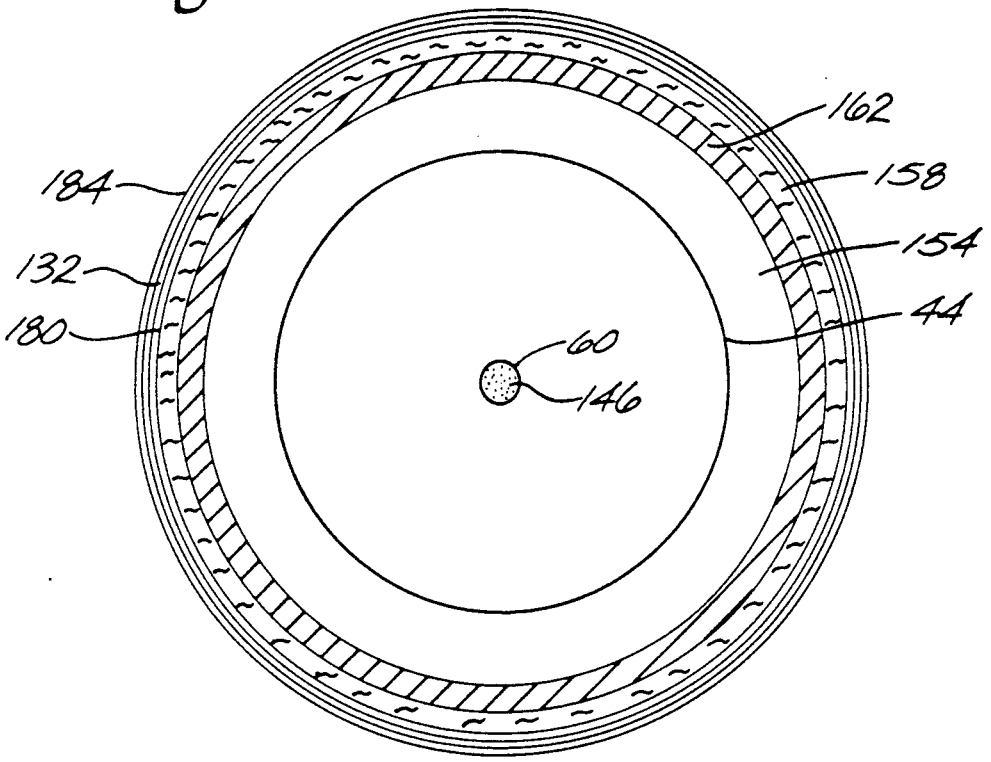
FIG. 8 is a schematic transverse cross section through the superconducting solenoid showing the non-magnetic turborecompressor mounted inside its bore and the surrounding containment vessel that supports the solenoid thereby enabling it to generate intense magnetic fields.

FIG. 5 is a longitudinal perspective view illustrating the design and construction of a low pressure axial flow thermally insulated turboexpander 40 with unlimited and variable expansion ratios and pressure ratios. FIG. 6 is a schematic transverse cross section illustrating the design and construction of one of the spiraling expansion blades 42 of the low pressure turboexpander 40 shown in FIG. 5. FIG. 7 is a schematic longitudinal perspective view illustrating the design and construction of a converging superconducting solenoid 44 mounted at the end of the condensing chamber 46 for magnetically removing non-condensed oxygen vapor 48 from the condensing chamber 46 and, isothermally magnetizing it thereby reducing its entropy. FIG. 8 is a transverse cross section of FIG. 7 further illustrating the design and construction of the superconducting solenoid 44 and its containment structure for supporting the stresses generated by the solenoid.

The expanded supersaturated oxygen vapor 50 leaving the condensing turboexpander 40 is discharged directly into a cryogenic vacuum chamber 52 that is maintained at a very low pressure. This vacuum chamber 52 is divided into two separate regions 54, 56 by the condenser 58 that is mounted between these regions. The first region 54 begins at the discharge end of the turboexpander 40 and ends at the inlet portion of the condenser 58. The second region 56 begings at the vapor discharge end of the condenser 58 and ends at the inlet portion of the superconducting solenoid 44. The only way that expanded oxygen vapor can reach the second half 56 of the vacuum chamber 52 is to pass through the condenser 58.

As shown in FIG. 7, a large low pressure non-magnetic turbine 59, (similar in design to the low pressure expansion turbine 40), is mounted at the end of the condensing chamber 56, and extends into the bore of the superconducting solenoid and ends near the beginning of the turborecompressor 60 where the field is most intense. The turbine 59 is designed to convert the kinetic energy of the noncondensed oxygen vapor drawn out of the condensing chamber by magnetic attractive forces generated by the superconducting solenoid into mechanical work so that the vapor moves into the bore of the solenoid without any significant increase in kinetic energy. This is an important operating feature of the invention because it enables the paramagnetic oxygen gas to be isothermally magnetized which results in the entropy reduction. This turbine 59 converts the heat of magnetization $\Delta H_m$ into mechanical work. It is connected to a central drive shaft and operated in tandem with the condensing expander 40 to drive the recompression turbine 60.

The recompression turbine 60 (FIG. 7) is mounted in the central region of the bore of the solenoid 44 and is designed for increasing the pressure of the magnetically compressed low entropy vapor inside the bore of the solenoid by a small amount (1.0 Bar) so that it can be moved out of the solenoid through a thermally insulated conduit and recycled back into the condensing expander, The central drive shaft 64 passes through the vacuum chamber 52 and connects the driving rotor 66 of the turboexpander 40 and magnetic energy turbine 59 directly to the driving rotor 68 of the turborecompressor 60 such that the rotating turboexpander 40 and magnetic energy turbine 59 supplies direct mechanical power to rotate the turborecompressor 60. Since the rotors of the expander 40, magnetic energy turbine 59 and recompressor 60 are joined together by the connecting drive shaft 64 to form a single rigid unit, the rotating system has only one moving part. Hence, the system can be designed to operate smoothly and continuously with very little friction. (By mounting the central drive shaft on frictionless magnetic bearings, there will be essentially zero frictional heat.)

It may be desirable to operate the rotors of the three turbines with different rotation speeds. In this case, various reduction gears will be required. By employing multiple drive shafts designed as two tightly fitting co-axial sleeves, it will be possible to mount the reduction gears outside the condensing system. This will keep the frictional heat generated by the reduction gears from entering the condensing system.

As illustrated in FIGS. 5 and 7, the turboexpander 40, vacuum chamber 52, condenser 58, magnetic energy turbine 59, superconducting solenoid 44, and turborecompressor 60 are all joined together and mounted inside a single, thermally insulated, compact unit or module 70 which comprises the condensing system. This compact module design therefore, obviates the need for a considerable amount of conduits, heat shields and related apparatus that would otherwise be needed if these components were designed and mounted inside separate units. Moreover, this compact unit module design feature also enables the incoming oxygen to be expanded, condensdd, and recompressed in a very efficient and continuous process that is close to ideal adiabatic flow conditions.

The turboexpander 40 comprises three rotating spiraling expansion blades 72 specifically designed for low pressure operation. The blades 72 begin at the end of an annular gas inlet duct 74 with a variable throat radius $R_1$, with the rotor's drive shaft 66 passing through its center. As shown in FIGS. 5 and 6, the radius of the spiraling expansion blades 72 steadily increase along the shaft 76 to some maximum value $R_2$ at the downstream end of the turboexpander 40. The clearance between the inside walls 78 of the turboexpander 40 and the rotating blades 72 is extremely small and on the outer of the 20 to 60 microns. The lateral end 80 of the blades 72 moving adjacent the turbine's inside walls 78 are thicker than the main body of the blades near the rotor shaft 66 and vary from about 3 blade thicknesses near the inlet to about 6 blade thicknesses near the outlet so that the boundary between the rotating blades 72 and the inside turbine walls 78 is essentially gastight. In order to minimize unwanted heat transfer between the beinning and end of the expander, the expansion rotor 66 and inside walls 78 of the expansion chamber 82 and vacuum chamber 52 are constructed with material having very low thermal conductivity such as Teflon or glass composite material.

The boundary between the spiraling expansion blades 72, the turbine walls 78 and the rotor shaft 66 defines three spiraling gastight passageways 84 with increasing cross sectional area. Consequently, these passageways represent spiraling expansion chambers 82 that spiral around the rotor shaft 66. If a partial vacuum with low pressure $P_2$ is continuously maintained at the end 86 of the blades 72 (i.e., inside the vacuum chamber 52) then oxygen at pressure $P_1$, flowing into the spiraling expansion chambers 82 will gradually decrease in pressure as it flows through the passageways 84 by virtue of its expansion. This decreasing pressure generates pressure differentials between both sides of all the blades 72 along their entire surface area. These pressure differentials generate unbalanced forces on the blades 72 that result in smooth and continuous rotational torque on the rotor shaft 66.

Oxygen gas at temperature $T_1$ and pressure $P_1$ is continuously fed into the turboexpander 40 through a variable diameter annular gas-inlet duct 74 at a steady, continuous rate and is uniformly expanded as it passes through the turbine. Since heat flow through the walls of the turboexpander is essentially eliminated by cryogenic insulation, the expansion is very nearly isentropic. If the pitch of the blades 72 is designed to maintain a constant axial flow velocity through the turbine equal to the axial inlet velocity, then the oxygen emerges at the end of the turbine with an expansion ratio r given by $$r = \frac{R_2^2 - R_0^2}{R_1^2 - R_0^2} \tag{9}$$

where $R_0$ denotes the radius of the rotor's drive shaft 66.

Since the throat radius $R_1$ is variable and can range from $R_1 = R_0$ to some maximum value equal to the initial blade radius, this expansion ratio can be varied from infinity to some minimum value (which is about 50). It was determined above that if the inlet temperature and pressure is 230.00° K. and 1.0 Bar respectively (with an entropy S=6.174 Joules/gm°K.) an expansion ratio of r=192.91 will reduce the expanded oxygen to a metastable supersaturated vapor as it is discharged into the vacuum chamber 52 (FIG. 5) resulting in a condensation ratio R=0.06527. Thus, for these inlet conditions, if $R_0$=0.50 cm and $R_2$=50 cm, then a throat radius $R_1$=3.633 cm will produce an expansion ratio of 192.91 and the expanded oxygen 88 entering the vacuum chamber 52 will be reduced to a supersaturated vapor at 56° K. The ability to change the expansion ratio while the turboexpander 40 is operating is a valuable design feature since it allows a means for controlling the mass flow rate m of incoming oxygen—and thus the engine's power.

A mechanical actuator 90 is connected to the variable diameter annular oxygen-inlet duct 74 which enlarges and reduces the radius of this duct from a minimum of $R_1 = R_0$ to some maximum value $R_1 = R_{max}$. When $R_1 = R_0$, the inlet duct 74 is completely closed and no oxygen passes through the turboexpander 40. (The expansion ratio r in this case is infinity.) When $R_1 = R_{max}$, the inlet duct 74 is completely open and the amount of oxygen flowing into the turboexpander 40 is maximum. (The expansion ratio is minimum in this case.) The actuator 90 is controlled by an electrical servo motor 92 that is activated by an energizing current from some outside source.

Referring to FIGS. 4 and 5 a thermally insulated oxygen inlet conduit 94 is connected to the variable annular oxygen-inlet duct 74 and has an inside radius greater than $R_{max}$. The other end of this oxygen inlet conduit 94 is connected to the thermally insulated cryogenic mixing vessel 22. The recycled oxygen discharged from the third cascading expansion system 20 (FIG. 4 ) is fed into the thermally insulated mixing vessel 22 via a thermally insulated conduit 98. The recompressed noncondensed oxygen vapor discharged from the superconducting solenoid 18 is fed into the mixing vessel 22 by means of another thermally insulated conduit 100.

Figure 9:
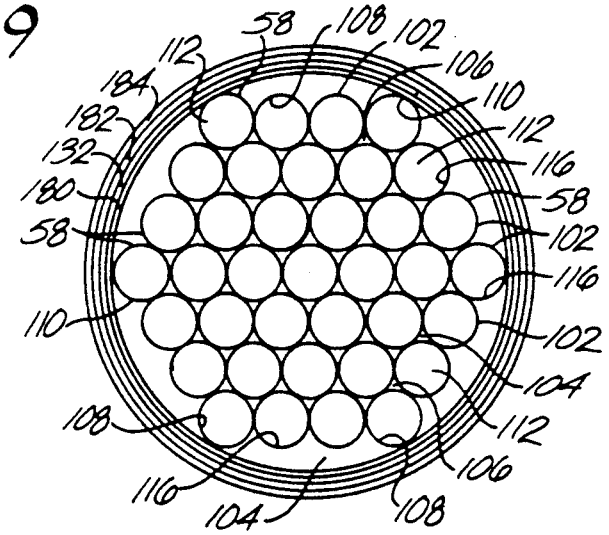
FIG. 9 is a schematic transverse cross section through the condenser illustrating the design and construction of the condensing tubes.
Figure 10:
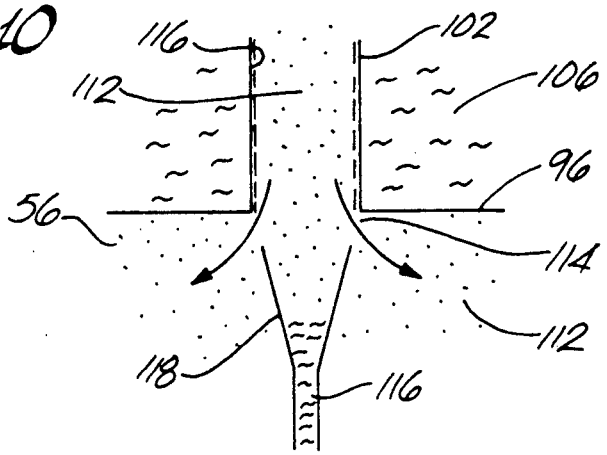
FIG. 10 is an enlarged longitudinal cross section through the end portion of one condensing tube illustrating the design and construction of the discharge passageways for the condensed fluid and noncondensed vapor that is discharged into the vacuum chamber.

FIG. 9 is a schematic transverse cross section through the condenser 58 illustrating the design and construction of a plurality of condensing tubes 102. FIG. 10 is an enlarged cross section through the end portion of one condensing tube illustrating the design and construction of a discharge passageway for the gaseous expanded oxygen vapor that does not condense after passing through the condensing tube 102. Referring to these figures, and FIG. 5, the condenser 58 comprises a plurality of parallel cylindrical condensing tubes 102 with high thermal conductivity. This system is mounted between two transverse bulkheads 96. The space 104 between these bulkheads 96 is always filled with liquefied oxygen 106 at about 56° K. Thus, the external walls of the condensing tubes 102 are immersed in a bath of cold liquefied oxygen 106 and therefore maintained at about 60° K. This internal liquefied oxygen reservoir 106 enables the inside walls 108 of the tubes 102 (condensing surfaces) to be maintained at low temperature while the engine is turned off so that it can be restarted. After the engine is started, the supersaturated metastable oxygen passing through the cryogenic condensing tubes 102 condense into droplets of liquid oxygen that form a layer of condensation 110 all along the inside walls 108 of the condensing tubes 102. There is very little heat transfer between the condensing metastable oxygen vapor and the liquefied oxygen 106 while the engine is operating because the temperature gradients are very small. Since the bulkheads 96 prevent any expanded oxygen vapor 112 discharged from the condensing expander 40 from passing around the outside of the condensing tubes 102, all of the expanded supersaturated vapor 112 leaving the condensing expander 40 must pass into the cold condensing tubes 102.

After passing through the cryogenic turboexpander 40 and undergoing an isentropic expansion (with an expansion ratio of 192.91), the expanded oxygen is discharged into the first region 54 of the vacuum chamber 52 as very cold metastable supersaturated vapor. The supersaturated oxygen vapor passes into the condensing tubes 102 and begins to liquefy into small droplets. The condensing tubes 102 are sufficiently long such that essentially all of the metastable, supersaturated oxygen vapor condenses on them before reaching the end. That portion of the vapor that is not metastable (but saturated) passes through the condensing tubes and escapes through a plurality of gaseous oxygen discharge passageways 114 (FIG. 10). These discharge passageways 114 lead directly into the second half 56 of the vacuum chamber 52. Since the noncondensed oxygen vapor is strongly paramagnetic, it is drawn out of the chamber 56 by magnetic attractive forces generated by the superconducting solenoid 44 (FIG. 7). Therefore, the vacuum environment of the vacuum chamber 56 is continuously maintained.

The mass flow rate $m_c$ of oxygen vapor condensing on the condensing walls 108 is given approximately by the equation $$m_c = kAP\sqrt{\frac{M}{T}} \tag{10}$$

where P denotes the chamber pressure, T denotes the wall temperature and M denotes the molecular weight of oxygen (32). The total area of the condenser walls 108 is denoted by A, and k is a constant. If the units of A, P and T are $cm^2$, torr (i.e., mm of Hg) and °K. respectively, then k=0.05833. (See, *Handbook of High Vacuum Engineering*, Reinhold Publishing Corporation, New York, 1963, pp. 72-76, by H. A. Steinherz.) For example, if T=56° K., $P=P_2=1.815$ torr (0.002 Bar) and A=10,000 $cm^2$ (1.0 $m^2$), then $m_c$=800 gm/sec. Thus, a relatively small condenser will be capable of providing a relatively high rate of condensation.

The condensing tubes 102 (FIG. 5) are mounted vertically inside the condensing system such that the liquefied oxygen 116 that condenses inside them on the condensing surfaces 108 run downward (via gravity flow) past the vapor discharge passageways 114, and into converging tube sections 118 where the liquefied oxygen accumulates. The converging tube sections 118 and vapor discharge passageways 114 are mounted inside the second half of the vacuum chamber 56 where the vapor is discharged. A central pick-up feeder conduit 120 is connected to all of the tube sections 118 and carries the liquefied oxygen 116 to a small compressor 122 where it is compressed to a pressure of 1.0 Bar. The liquefied oxygen 116 is discharged from the compressor 122 via a conduit 124 that feeds the liquefied oxygen 116 into the superconducting solenoid system where it is utilized as a cryogenic refrigerant. A pressure activated one-way relief valve 126 is mounted on the conduit 124 that prevents liquid oxygen from back flowing and reentering the condensing tubes due to pressure variations. After serving as a cryogenic refrigerant for the solenoid, the liquefied oxygen is fed into the internal liquid oxygen vessel 104 via another conduit 128. As described above, the internal liquid oxygen vessel 104 is always kept full of liquefied oxygen 106 so that the condensing tubes 102 are always completely immersed in liquefied oxygen. Thus, as liquefied oxygen is fed into the vessel 104 via conduit 128, an equal amount of liquefied oxygen 106 is withdrawn from the vessel 104 via another conduit 130. This conduit 130 carries the liquefied oxygen into a double walled cryogenic Dewar jacket 132 that completely surrounds the entire condensing system thereby providing it with a cryogenic environment that is maintained at about 56° K. even when the condensing system is not operating.

The most important component of the condensing system is the superconducting solenoid 44 (FIG. 7). As described above, the solenoid 44 is mounted at the end of the condensing chamber 56 and is designed to remove noncondensed oxygen vapor from the chamber 56 by magnetic attractive forces utilizing the fact that oxygen is a highly paramagnetic gas. Thus, as shown in FIG. 7, the noncondensed vapor 134 is pulled through the turbine 59 and into the bore 136 of the solenoid 44 by an intense magnetic field 138 and undergoes isothermal magnetic compression, The solenoid 44 is designed with a bore 136 that converges inward to its narrowest region 140 where the magnetic field is most intense. This provides a gradual gradient in the magnetic field for optimizing the magnetic attractive forces exerted on the oxygen molecules 134.

The turbocompressor 60 is mounted in the narrowest region 140 of the bore 136 where the magnetic field is most intense. The turbocompressor 60 is driven by the central rotating shaft 68 that extends along the central axis of the condensing system which is connected to the rotor 66 of the expander 40 and the turbine 59. The rotating drive shaft 68 is mounted inside a protective tube 142 (sleeve) which remains fixed and held in place by a plurality of mounting struts 144. The turbocompressor 60 increases the pressure of the magneticcally compressed oxygen 146 a small amount (1.0 Bar) in order to remove the gas from the bore with a residual gas pressure of 1.0 Bar. Since the entropy of the oxygen 146 is reduced by the magnetic field, the work consumed by the turbocompressor 60 is significantly reduced so that all of the work needed to operate the turbocompressor 60 is supplied by the mechanical work generated by the expander 60 and the turbine 59 via the connecting drive shaft 68.

The recompressed oxygen is discharged from the solenoid 44 and condensing system via a thermally insulated conduit 148. This conduit 148 has an annular transverse cross section with the drive shaft 68 extending along its central axis. The conduit 148 is connected to the return conduit 100 which carries the recompressed oxygen 150 to the mixing vessel 22 where it is mixed with oxygen gas discharged from the third cascading expander 20 (FIG. 4). The conduit 148 is equipped with a pressure activated one-way relief valve 152 to prevent any oxygen from back flowing and reentering the solenoid 44 through the conduit 148 after it leaves the solenoid. As in the design of the liquid oxygen relief valve 126, this relief valve 152 automatically regulates the pressure produced by the turbocompressor 60. The turbocompressor 60, turbine 59, drive shaft 68, protective tube 142, and conduit 148 are all constructed with material such as fiberglass or plastic with very low magnetic susceptibility so as to not disturb the magnetic field 138. Likewise, the condensing chamber 52 and various conduits are also constructed with material having very low magnetic susceptibility. (The condensing tubes 102 could be constructed with copper which has very low magnetic susceptibility but very high thermal conductivity.)

As is illustrated in FIGS. 7 and 8, the solenoid 44 is encased in a thick, super-strong mold 154 constructed with fused silica fibers or a solid block of fused quartz, which serves as an external containment structure for supporting the enormous stresses generated by the solenoid's magnetic field. Without this containment structure 154, the solenoid 44 would burst apart even though the superconductor of the solenoid is constructed with stress bearing material.

The detailed design and construction of the stress bearing superconducting cable used in the construction of the solenoid is essentially identical to that disclosed in my U.S. Pat. No. 4,078,747 filed June 2, 1975. By surrounding the external walls of the solenoid 44 with a super-strong immovable containment structure 154 that can (by design) be made sufficiently large to withstand any outward forces generated by the solenoid, it will be possible for the solenoid to generate magnetic fields as high as 300 T before the bulk modulus limit of the cable (and containment structure) is reached and volume compression begins.

The process of charging up the solenoid with electric current to the required inductive energy in order to generate a 100 T magnetic field is accomplished gradually over a long time period that may span several days. This procedure is designed to allow the cables in the solenoid to adjust themselves by slight deformation to the extremely high stresses that are exerted on them by the magnetic field. This long time period will also provide time for removing the large amount of heat generated by the stress induced deformations while maintaining a cryogenic environment for the solenoid. Thus, the solenoid will gradually change its shape during the charging up period as it is compressed against the surrounding immovable inner walls of the containment structure 154. The strength of the containment structure 154 can be made arbitrarily high to support essentially any stresses that the solenoid could generate up to the bulk modulus limit of the material used in its construction, which will be on the order of $10^{11}N/m^2$. Thus, in the preferred embodiment, the superconducting solenoid will always remain in a fully charged condition even when the engine is not running so as to not disturb its stress field. (This will also eliminate the production of heat caused by a varying magnetic field.) However, some small variations in its magnetic field will be allowed to provide greater engine control.

The solenoid is cooled to cryogenic temperature by maintaining the external walls of the containment structure 154 at cryogenic temperature. This is achieved by mounting the containment structure 154 inside a cryogenic Dewar 156 filled with cryogenic coolant 158. Thus, the external walls 160 of the containment structure 154 are in direct thermal contact with the cryogenic coolant 158.

With the discovery of superconducting material having higher and higher critical temperatures, it may be possible to construct the solenoid 44 with a superconductor capable of operating at ambient temperature. In this case there would be no need for any cooling system. There are strong indications that material with superconducting critical temperatures above ambient temperature will soon be developed. See the article, "High $T_c$ May Not Need Phonons; Supercurrents Increase," Physics Today, July 1987, pp. 17"21, by Anil Khurana.

As shown in FIGS. 7 and 8, the superconducting solenoid 44 and its containment structure 154, and Dewar 156, are mounted inside a ferromagnetic housing 162. This housing 162 is designed to contain the magnetic field of the solenoid within the condensing system. In order to reduce the overall weight of the condensing system, the ferromagnetic housing 162 could be replaced by superconducting shielding coils. See, "Multilayer $Nb_3S_n$ Superconducting Shields," *IEEE Transactions On Magnetics*, Vol. MAG-21, No. 2, March 1985, pp. 320–323, by D. V. Gubser et al.

A small electric generator 164 (i.e., flux pump) is mounted adjacent the discharge conduit 148 that is driven by the central drive shaft 68 via a mechanical linkage 166. Since the magnetization M' of the oxygen leaving the solenoid will be less than that entering, this generator 164 supplies an amount of energy equal to $\frac{1}{2}(1-M)B(M-M')$ via connecting wires 168 so that the inductive energy of the solenoid remains constant.

An electric isentropic vacuum pump 170 is mounted near the electric generator 164 for evacuating the condensing chamber 52 if such evacuation is required prior to feeding any oxygen into the condensing expander 40. This pump 170 is energized by an external power source such as a storage battery. The gas removed from the chamber 52 can be cooled by liquefied oxygen and fed into the mixing vessel 22 for recycling back through the condensing system before the engine is restarted.

In the preferred embodiment, the solenoid is constructed with a superconductor 172 having a critical temperature above the triple point of oxygen (54.4° K.) such that liquefied oxygen can be utilized as a cryogenic refrigerant Thus, the liquefied oxygen produced inside the condensing tubes 102 is circulated through the cooling Dewar 156 via an inlet conduit 174, circulated through the Dewar 156 as a cryogenic coolant 158, and withdrawn via another conduit 176.

It should be pointed out and emphasized herein that a solenoid constructed with a superconductor having a critical temperature above the triple point of oxygen is not a necessary feature or operating condition in the practice of this invention. If the solenoid is constructed with a superconductor that requires a very low temperature coolant, such as liquid helium, then liquefied helium is circulated through the cooling Dewar 156 instead of liquefied oxygen. In view of the very low tempeatures produced inside the condenser, and the fact that the solenoid will be operated with negligible changes in its inductive energy, and since the solenoid will be thermally insulated from the environment, and from the magnetically compressed oxygen inside its bore, the amount of heat transferred to the coolant 158 will be very low. Thus, if liquid helium is used as the coolant, very little replenishment will be necessary, but means for this replenishment would obviously be required from outside sources. In this embodiment of the invention, an external liquid helium storage vessel 178 is provided (FIG. 7).

All of the various components inside the condensing system are protected by a thick inner jacket of evacuated multilayer cryogenic insulation 180 (FIGS. 5,7,8). This jacket 180 is completely enclosed within a thick Dewar jacket vessel 132 containing a relatively large amount of liquefied oxygen 182. After circulating through the Dewar jacket vessel 132, the liquefied oxygen 182 is fed into the external liquefied oxygen vessel 26 (FIG. 4) via a thermally insulated cryogenic conduit 183. Finally, the cryogenic Dewar vessel 132 is itself completely enclosed within a thick outer jacket of evacuated multilayer thermal insulation 184.

The cascading expanders 32,36,20 are similar to those disclosed by E. H. Schwarzman in his U.S. Pat. No. 3,451,342 filed Oct. 24, 1965 entitled "Cryogenic Engine System and Method". Consequently, the detailed construction of these cascading expanders is considered to be within the prior art and no detailed description is given herein.

Since the rate m (kg/sec) of mass flow of oxygen entering the turboexpander is given by $m=\rho A_1 u$ where $A_1$ denotes the transverse cross sectional area of the inlet duct, and where $\rho$ and u denote the density and flow velocity of the oxygen passing through the duct respectively, the total net power output $P_{net}$ of the condensing cryogenic engine can be expressed as $$P_{net}=29.714\ \rho A_1 u\ (KW) \tag{11}$$

The temperature $T_1$ and pressure $P_1$ of the oxygen moving through the inlet duct are 230.00° K. and 1.000 Bar respectively. Hence, the corresponding density $\rho=1/V_1=1.676$ kg/m$^3$ (which is obtained from the thermodynamic property data).

Since the expansion ratio r=192.91 is assumed to be constant, and if the flow velocity u is constant as the oxygen expands through the expander (which can be obtained by design) then the expansion ratio $r=A_2/A_1$ where $A_2=\pi(R_2^2-R_0^0)$ represents the cross sectional area of the condensing expander's outlet duct. Therefore, the value of $R_2$ determines the power output of the engine. Since the diameter of the condensing system is approximately equal to $2R_2$, and since the length-to-diameter ratio of the condensing system will be approximately equal to 2.5, the power output of the engine is determined by the size of the condensing system. Thus, it is convenient to express the total net power output $P_{net}$ of the engine as a function of $R_2$ assuming the above values for $T_1$, $P_1$, and r remain constant. Assuming a relatively low flow velocity u=10 m/sec, this expression is $$P_{net}=23.829\ R_2^2(KW) \tag{12}$$

where $R_2$ is given in meters (m). Thus, the net power output $P_{net}$ of the engine increases as the square of the outlet radius $R_2$ of the condensing expander. This represents the basic scaling relationship of the engine and demonstrates that the engine can be scaled upward to produce significant output power and cooling power by increasing $R_2$ by relatively small amounts. For example, if $R_2=10$ m, $P_{net}=2.4$ MW.

Figure 11:
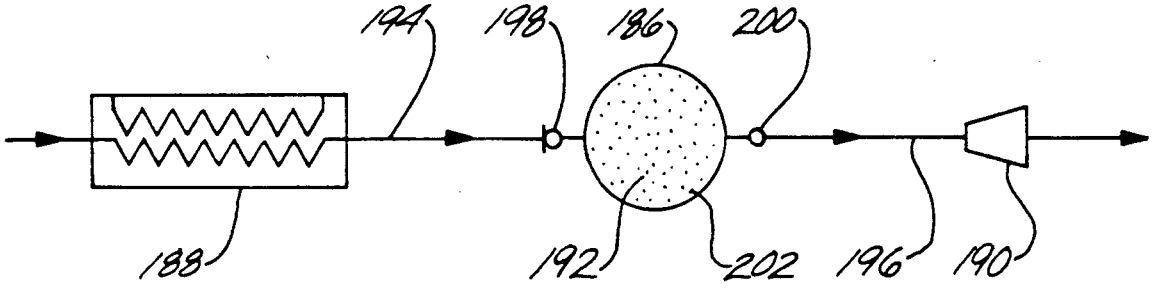
FIG. 11 is a block diagram illustrating an alternative embodiment of the condensing cryogenic engine where a pressure vessel is interposed between a heat exchanger and its downstream expander for energy storage, load leveling and instant power.

Pressure vessels could be interposed between an ambient heat exchanger and its adjacent downstream expander and serve as a compressed gas energy storage reservoir that is fed into the adjacent expander. FIG. 11 illustrates this important design feature. As is shown in this figure, the pressure vessel 186 is operatively interposed between an ambient heat exchanger 188 and its downstream expander 190. The pressurized oxygen gas 192 leaves the heat exchanger 188 by a pressure conduit 194 and is transferred to the pressure vessel 186. The compressed oxygen 192 inside the pressure vessel 186 is fed to the expander 190 by another pressure conduit 196. A one-way check valve 198 is mounted on the conduit 194 between the heat exchanger 188 and the pressure vessel 186 to prevent any gas already inside the pressure vessel 186 from flowing back into the heat exchanger 188 due to pressure variations inside the heat exchanger 188. This pressure vessel 186 represents a compressed gas, load leveling, energy reservoir for storing a considerable amount of pressurized gas (at ambient temperature) for the expander 190. This compressed gas energy reservoir enables the power output of the expander 190 to be rapidly varied over a wide range without requiring large and rapid changes in the mass flow rate m of the oxygen flowing through the condensing system. When the engine is turned off, a valve 200 mounted on the conduit 196 between the pressure vessel 186 and the expander 190 is closed thereby preventing the pressurized gas inside the pressure vessel 186 from escaping after the engine is turned off. When the engine is restarted, the expander 190 utilizes the reserve compressed gas inside the pressure vessel 186 to generate instant power without having to first compress liquid oxygen and then circulate it through the heat exchangers. With this system it will be possible for the engine to generate mechanical power over fairly long intermittant time periods that is much higher than that represented by the mass flow rate m entering the condensing system given by equation (8).

By constructing the pressure vessels 186 with thick walled ultra high strength glass fiber or composite material and using a toroidal design, pressures on the order of 500 Bar will be possible. Since the volume energy density of compressed gas at pressure P is equal to $P/(\gamma-1)$, where $\gamma\approx1.50$, the stored energy density corresponding to a pressure of 500 Bar still will be $10^8$ Joules/$m^3$. Therefore, these pressure vessels could contain a large amount of stored energy. However, whenever the engine is operated with the condensing system turned off, the third cascading expander will probably also have to be turned off so that the expanded oxygen gas discharged from the upstream expanders can be accumulated in the second pressure vessel. Thus, the second pressure vessel will be designed with a higher volume capacity than that of the upstream storage vessel. A plurality of pressure transducers 202 sense the gas pressure in the pressure vessels. When the pressure drops below a certain minimum, the condensing system 10 and compressor 28 (FIG. 4) are automatically activated to restore the pressure. (It should be pointed out however, that while this embodiment of the engine will be important, the ambient heat exchangers 30,34,38 of the basic embodiment shown in FIG. 4 will have some relatively large internal gas volume inherent in its construction that will also produce this beneficial stored compressed gas energy reservoir effect.)

It should also be noted that the large external liquid oxygen vessel 26 (FIG. 4) represents another large energy storage reservoir that can be used to generate mechanical power without having to operate the condensing system. This can be achieved by simply withdrawing liquefied oxygen from this reservoir, compressing it to the working pressure (500 Bar) and feeding it into the first ambient heat exchanger 30 and adjacent expander 32. The vapor discharged from the expander 32 can be accumulated (at low temperature) in a large thermally insulated pressure vessel prior to feeding it into the second heat exchanger 34 and second expander 36. The accumulated gas could be fed into the second heat exchanger 34 and second expander 36 when the condensing system is turned on. There are many different operating modes that the engine could use to generate mechanical power and refrigeration by using stored gas pressure vessels.

In still another variation of the basic embodiment of the engine shown in FIG. 4, an additional compressor can be operatively interposed between the exhaust duct of the first cascading expander 32 and the inlet duct of the following serially connected ambient heat exchanger 34 in order to recompress the expanded working fluid to a higher pressure before it is reheated. This will increase the net power output of the engine.

In order to obtain more control of the engine, the compressor 28 (FIG. 4) could be designed with variable output pressure and all of the cascading expanders could be designed with variable expansion ratios.

It should also be pointed out that the oxygen entering the expansion chamber could have many different values of $T_1$ and $P_1$ in order to optimize the engine's overall performance. The pressure of the liquefied oxygen withdrawn from the compressor 28 (FIG. 4) could be higher or lower than the 500 Bar pressure assumed in the preferred embodiment.

Since a working pressure of 500 Bar (7,252 lbs/$in^2$) may be impractical for some applications of the engine, it is possible to design the engine with a much lower working pressure using only two heating steps instead of three heating steps.

Figure 12:
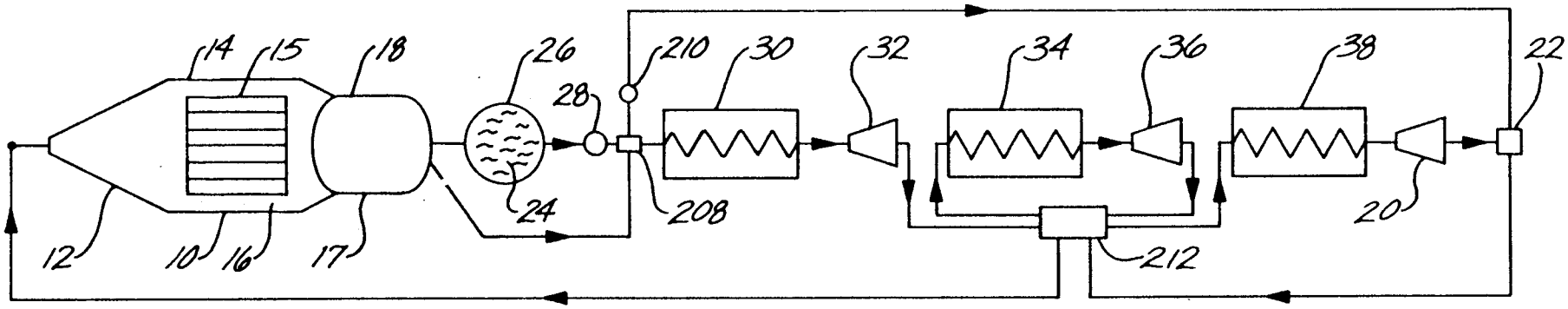
FIG. 12 is a block diagram illustrating an alternative embodiment of the condensing system of a cryogenic engine designed to increase the condensaratio

FIG. 12 is another alternative embodiment that is designed to produce a higher condensation ratio R. Basically, this is achieved by utilizing the compressed liquefied oxygen withdrawn from the compressor 28 as a cryogenic coolant for reducing the entropy of the noncondensed oxygen before it is recycled back into the condensing system. Since the compressed liquefied oxygen leaving the compressor 28 at cryogenic temperature has to be heated back to ambient temperature by extracting natural heat energy from the environment at ambient temperature, it is first utilized to extract heat energy from the noncondensed oxygen, thereby lowering its entropy before this recycled oxygen is fed into the mixing vessel 22. Likewise, the very cold compressed oxygen gas discharged from the first high pressure expander 32 (at 150.244°) and the second high pressure expander 36 (at 112.353° K.) is utilized as coolant for cooling the gas in the mixing vessel 22 before this gas is recycled back into the condensing system. This will reduce the entropy of the vapor entering the condensing system thereby increasing the condensation ratio. Since in this embodiment, the magnetic field inside the condensing system 10 will not be able to reduce the entropy of the noncondensed vapor all the way back to the preexpansion entropy, the recompression will take place in two stages. The first stage will be accomplished by the recompressor 60 mounted inside the superconducting solenoid 18 of the condensing system 10. This recompressor will recompress the noncondensed vapor such that it leaves the condensing system (after adiabatic demagnetization) with a pressure of about one-half the initial preexpansion pressure. However, since the entropy of this partially compressed vapor is fairly high, its temperature (even after adiabatic demagnetization) will be fairly high. (It may exceed the initial preexpansion temperature.) Thus, this high temperature, partially recompressed vapor is fed into a thermally insulated cryogenic heat exchanger 208 where it is cooled by transferring heat to the compressed liquefied working fluid which is circulated through the heat exchanger 208 after leaving the compressor 28 at 60.222° K. After circulating through this cryogenic heat exchanger 208, the partially compressed, noncondensed vapor is cooled to a much lower temperature (and to a lower entropy) and fed into another isentropic compressor 210 where it is compressed up to the initial preexpansion pressure. By recompressing the noncondensed vapor in two stages, separated by the cooling step, the amount of mechanical work required for the complete recompression is significantly reduced.

After the noncondensed vapor is recompressed back to the initial pressure, it is withdrawn from the second compressor 210 and fed into the mixing vessel 22. The design is such that the gas discharged from the last expander 20 (at the desired preexpansion pressure) has a much lower temperature than that of the recompressed noncondensed gas such that when the two components are mixed together, the noncondensed gas is further cooled (and reduced in entropy). The resulting mixture is then fed into another thermally insulated low temperature heat exchanger 212 where the exhaust gases discharged from the first high pressure expander 32 and second high pressure expander 36 at low temperature are circulated as coolant for cooling all the recycled gas down to a fairly low preexpansion temperature thereby lowering the entropy still further. Afrer this third cooling step, the gas is recycled back into the condensing system.

It is beyond the intended scope of this disclosure to present any detailed quantitative analysis of this embodiment, but it could represent a design capable of generating significantly higher condensation ratios R and therefore increased power.

There are many other variations and modifications of the condensing system that can be used to increase performance. The system could also be used for many different applications besides cryogenic engines. For example, the condensing system shown in FIG. 1 could be used for manufacturing liquid oxygen directly from the ambient atmosphere. A strong magnetic field could be used to separate the oxygen molecules from the other diamagnetic molecules in atmospheric air. The oxygen could then be expanded to low temperature and pressure, and fed into the condensing system. (Condensation could also take place in the solid phase with much lower temperatures.)

Still other embodiments and variations of the basic invention are possible. For example, since nitric oxide (NO) is another gas that is naturally paramagnetic, a magnetic condensing system and cryogenic engine could also be designed using this gas as the working fluid instead of oxygen. Thus, this design represents another variation of the basic embodiment of the invention. However, since oxygen has a higher magnetic susceptibility than nitric oxide, oxygen is the preferred working fluid. It may be possible to artificially create other inorganic or organic gases that are strongly paramagnetic for use in the practice of this invention but oxygen appears to be the only practical paramagnetic working fluid that could be used in the invention.

Still another variation of the invention could be obtained by lowering the condensation temperature $T_2$ below the triple point of the working fluid so that condensation is represented by solidification of the gas instead of liquefaction. This could result in a higher condensation ratio. The method for reducing the entropy of the expanded working fluid by the use of magnetic fields as taught in the present invention will produce a greater effect at lower temperatures. Since the required magnetic field strength B of the superconducting solenoid is determined essentially by the ratio $B/T_2$ (which should be about 0.7 Tesla/K.°) it would be possible to reduce the required strength of the magnetic field by designing the condenser to operate at much lower temperatures. But these advantages have to be measured against the disadvantages that result in the formation of solidified working fluid and very high expansion ratios (exceeding 10,000).

Another variation of the condensing system would involve reducing entropy by connecting a plurality of solenoids together in a series so that the total entropy reduction can be accomplished by several stages. Employing multiple solenoids in a parallel design could also be used in another embodiment. This would increase the mass flow through the condensing expander for increased power.

As various other changes and modifications can be made in the above method and apparatus for condensing working fluid without departing from the spirit or scope of the invention, it is intended that all subject matter contained in the above description or shown in the accompanying drawings should be interpreted as illustrative and not in a limiting sense.

What is claimed is:

1. A method for maintaining a low pressure for the working fluid inside a condensing chamber comprising the steps of:

using a working fluid that is paramagnetic; and removing noncondensed gaseous working fluid from said condensing chamber by means of a magnetic field thereby maintaining said condensing chamber at a low pressure.

2. A method as set forth in claim 1 wherein said paramagnetic working fluid is oxygen.

3. A method as set forth in claim 1 wherein said magnetic field is generated by a superconducting magnet.

4. A method as set forth in claim 3 wherein said superconducting magnet is a solenoid having a central bore communicating with said condensing chamber.

5. A method as set forth in claim 4 further comprising the steps of:

magnetizing a portion of said gaseous noncondensed working fluid removed from said condensing chamber inside said bore by said magnetic field; and removing heat of magnetization thereby lowering its entropy.

6. A method as set forth in claim 5 wherein said step of removing heat of magnetization is accomplished by the step of mounting a turbine means in the stream of paramagnetic gas moving into said solenoid.

7. A method as set forth in claim 5 further comprising the steps of:

mounting a compressor means inside said bore;

mounting conduit means communicating with said bore;

increasing the pressure of said gaseous working fluid inside said bore by said compressor means thereby forcing said gaseous working fluid out of said bore through said conduit means; and expanding said gaseous noncondensed working fluid at some initial pressure into said low pressure condensing chamber with a sufficiently high expansion ratio in order to condense a portion of said gaseous working fluid inside said condensing chamber.

8. A method as set forth in claim 7 wherein said compressor means and said conduit means are constructed with material having low magnetic susceptibility.

9. A method as set forth in claim 3 wherein said superconducting magnet is constructed with a superconductor having a critical temperature above the temperature of condensed working fluid, and further comprising the step of utilizing condensed working fluid as a coolant for maintaining said superconductor below said critical temperature.

10. A method as set forth in claim 4 wherein said magnetic field inside said bore is greater than 20 T.

11. A method as set forth in claim 3 further comprising the step of mounting means around a portion of said superconducting magnet to confine said magnetic field.

12. A method as set forth in claim 3 further comprising the step of thermally insulating said condensing chamber and said superconducting magnet from the ambient environment.

13. A method as set forth in claim 1 further comprising the steps of:

withdrawing condensed working fluid from said condensing chamber;

compressing said condensed working fluid to a pressure significantly greater than the pressure inside said condensing chamber; and performing at least once the sequential steps of passing said compressed working fluid through a heat exchanger means maintained in thermal contact with a heat reservoir whereby the compressed working fluid is heated by extracting and absorbing heat energy from said heat reservoir, and expanding said heated compressed working fluid inside an expander means whereby a portion of said heat energy absorbed by said working fluid is converted into mechanical work.

14. A method as set forth in claim 13 wherein the expanded working fluid emerging from said sequency of steps is further expanded into said low pressure condensing chamber with a sufficiently high expansion ratio in order to recondense a portion of said working fluid.

15. A method as set forth in claim 13 wherein said heat reservoir is the natural environment at ambient temperature.

16. A method for reducing the entropy of the working fluid of a heat engine at subambient temperature comprising the steps of:

using a working fluid that is paramagnetic;

subjecting said working fluid to a magnetic field at subambient temperature; and removing heat of magnetization from the working fluid.

17. A method as set forth in claim 16 wherein said paramagnetic working fluid is oxygen.

18. A method as set forth in claim 16 wherein said magnetic field is generated by a superconducting magnet.

19. A method as set forth in claim 18 wherein said superconducting magnet is a solenoid having a central bore wherein said working fluid is pulled by magnetic attractive forces and magnetized.

20. A method as set forth in claim 19 wherein said step of removing said heat of magnetization is accomplished by the step of mounting turbine means in the stream of paramagnetic gaseous working fluid moving into said solenoid.

21. A method as set forth in claim 20 further comprising the steps of:

expanding said working fluid in a gaseous state inside a low pressure chamber means with a sufficiently large expansion ratio to induce spontaneous condensation of a portion of said working fluid;

magnetically removing noncondensed working fluid from said chamber means by passageway means communicating with the bore of said superconducting solenoid thereby maintaining the low pressure environment of said chamber means;

removing heat of magnetization by said turbine means thereby lowering the entropy of said noncondensed magnetized working fluid;

removing said noncondensed working fluid from said solenoid; and reexpanding said noncondensed working fluid back into said chamber means.

22. A method as set forth in claim 21 wherein said heat engine is a cryogenic engine further comprising the step of withdrawing condensed working fluid from said chamber means and utilizing said fluid as working fluid for said cryogenic engine.

23. A method for operating a condensing system at subambient temperature comprising the steps of:

using a working fluid that is paramagnetic;

subjecting said working fluid to a magnetic field; and removing heat of magnetization from the working fluid.

24. A method for operating a cryogenic engine in a closed cycle comprising the steps of:

using a working fluid that is paramagnetic; and reducing entropy in a condensing system by subjecting said working fluid to a magnetic field and removing heat of magnetization from the working fluid.

25. An apparatus for reducing the entropy of the working fluid of a cyclic heat engine at subambient temperature comprising:

a paramagnetic working fluid;

means for magnetizing said paramagnetic working fluid at subambient temperature by a magnetic field; and means for removing heat of magnetization from the working fluid.

26. An apparatus as set forth in claim 25 wherein said working fluid is oxygen.

27. An apparatus as set forth in claim 25 wherein said magnetic field is generated by a superconducting solenoid having a bore containing a magnetic field wherein said magnetizing means comprises means for drawing a portion of said paramagnetic working fluid into said bore by magnetic attractive forces, and wherein said means for removing heat of magnetization comprises turbine means mounted in the gas stream moving into said bore.

28. An apparatus as set forth in claim 27 further comprising:

compressor means mounted inside said bore for compressing said magnetized paramagnetic working fluid; and conduit means connected to said bore for moving compressed working fluid out of said solenoid.

29. An apparatus as set forth in claim 27 wherein said solenoid is constructed with a superconductor having a critical temperature above the triple point of said working fluid, and further comprising means for utilizing liquefied working fluid as a coolant for maintaining said superconductor below said critical temperature.

30. An apparatus as set forth in claim 25 wherein said heat engine converts heat energy in a heat reservoir into mechanical work further comprising heat exchanger means mounted in thermal contact with the natural environment for utilizing the natural heat energy in the environment at ambient temperature as said heat reservoir.

31. An apparatus as set forth im claim 30 further comprising:

means for compressing said paramagnetic working fluid to some initial pressure at subambient temperature;

conduit means for circulating said compressed working fluid through said heat exchanger means thereby heating said working fluid by absorbing natural heat energy from the environment;

means for expanding said heated working fluid thereby converting a portion of said absorbed natural heat energy into mechanical work;

means for condensing a portion of said expanded working fluid inside a condensing means;

means for recompressing said condensed working fluid back to said initial pressure;

means for magnetizing that portion of the expanded working fluid which does not condense and removing heat of magnetization thereby reducing its entropy; and means for recompressing said magnetized working fluid.

32. An apparatus as set forth in claim 31 wherein said condensing means comprises:

means for expanding said working fluid into a low pressure chamber means with an expansion ratio sufficiently high to reduce the expanded working fluid to a supersaturated vapor at subambient temperature so that a portion of the expanded vapor condenses inside said chamber means;

means for removing said condensed working fluid from said chamber means;

means for removing noncondensed gaseous vapor from said chamber means by magnetic attractive forces generated by a magnetic field;

means for magnetizing said noncondensed vapor removed from said chamber means by a magnetic field;

means for removing heat of magnetization thereby lowering its entropy;

means for compressing said magnetized working fluid; and means for recycling said recompressed working fluid back into said condensing means.

33. An apparatus as set forth in claim 32 further comprising means for thermally insulating said condensing means from the ambient environment.

34. An apparatus as set forth in claim 32 wherein said expansion ratio is greater than 50.

35. An apparatus for condensing the working fluid of a cryogenic engine comprising:

a working fluid that is paramagnetic;

means for expanding said working fluid from some initial pressure into a low temperature, thermally insulated, condensing chamber with a sufficiently high expansion ratio to supersaturate the expanded vapor such that a portion of said vapor condenses inside said chamber at cryogenic temperature;

means for maintaining said condensing chamber at low pressure by magnetically removing noncondensed vapor from said chamber by a magnetic field;

means for magnetizing said noncondensed vapor removed from said chamber;

means for removing heat of magnetization from said vapor thereby reducing its entropy;

means for recompressing said magnetized vapor removed from said condensing chamber; and means for reexpanding said recompressed vapor back into said condensing chamber.

36. An apparatus as set forth in claim 35 wherein said means for magnetically removing expanded noncondensed vapor from said condensing chamber and magnetizing said vapor comprises a superconducting solenoid having a central bore with a magnetic field communicating with said condensing chamber such that noncondensed vapor is pulled out of said chamber into the bore of said solenoid by magnetic attractive forces where it is magnetized.

37. An apparatus as set forth in claim 36 wherein said means for removing heat of magnetization comprises a rotating turbine mounted in the gas stream moving into said bore wherein kinetic energy of said gas generated by said magnetic attractive forces is converted into mechanical work.

38. An apparatus as set forth in claim 36 wherein said means for recompressing said magnetized noncondensed working fluid comprises:

a compressor means mounted inside said bore for compressing said magnetized working fluid; and conduit means connected to said bore for withdrawing said compressed working fluid from said superconducting solenoid.

39. An apparatus as set forth in claim 38 further comprising means for driving said compressor means mounted inside said solenoid by mechanical work generated by expanding working fluid into said condensing chamber.

40. An apparatus as set forth in claim 38 wherein said compressor means mounted inside said bore is constructed with material having low magnetic susceptibility.

41. An apparatus as set forth in claim 36 wherein said superconducting solenoid is constructed with a current carrying superconductor having a critical temperature above the temperature of said condensed working fluid, and further comprising means for utilizing said condensed working fluid withdrawn from said condensing chamber as a cryogenic coolant for maintaining said superconductor below said critical temperature.

42. An apparatus as set forth in claim 36 further comprising means mounted around a portion of said superconducting solenoid to confine said magnetic field.

43. An apparatus as set forth in claim 36 further comprising means for thermally insulating said condensing expander, condensing chamber, and superconducting solenoid from the natural environment at ambient temperature.

44. An apparatus as set forth in claim 36 wherein the magnetic field inside said bore exceeds 20 T and further comprising a supporting structure mounted around a portion of said solenoid to provide external support for said solenoid.

45. An apparatus as set forth in claim 35 wherein said paramagnetic working fluid is oxygen.

46. An apparatus as set forth in claim 35 wherein said paramagnetic working fluid is vaporizable at ambient temperature further comprising:

means for compressing said condensed working fluid at cryogenic temperature to a pressure significantly higher than said initial pressure;

heat exchanger means maintained in thermal contact with the ambient environment for heating said cryogenic working fluid;

means for introducing compressed cryogenic working fluid into said heat exchanger means whereby said working fluid is heated and vaporized to a compressed gas by absorbing natural thermal energy from the ambient environment;

expander means for converting thermal energy of heated cryogenic working fluid into mechanical work; and means for introducing said heated cryogenic working fluid into said expander means whereby a portion of said natural heat energy absorbed from the natural environment is converted into mechanical work.

47. An apparatus as set forth in claim 46 further comprising means for recycling said expanded working fluid back into said condensing chamber in a closed cycle.

48. An apparatus for maintaining a low pressure inside the condensing chamber of a cyclic heat engine comprising:

a working fluid that is paramagnetic;

means for creating a magnetic field; and means for magnetically removing gaseous working fluid from said condensing chamber by means of said magnetic field.

49. An apparatus as set forth in claim 48 wherein said paramagnetic working fluid is oxygen.

50. An apparatus as set forth in claim 49 wherein said magnetic field is generated by a superconducting magnet.

51. An apparatus as set forth in claim 50 further comprising means mounted around a portion of said superconducting magnet to confine said magnetic field.

52. An apparatus as set forth in claim 50 wherein said superconducting magnet is a solenoid having a central bore communicating with said condensing chamber wherein noncondensed working fluid inside said condensing chamber is pulled into said bore by magnetic attractive forces and magnetized by said magnetic field and further comprising means for extracting heat of magnetization from said working fluid thereby reducing its entropy.

53. An apparatus as set forth in claim 52 wherein said bore has a magnetic field exceeding 20 T.

54. An apparatus as set forth in claim 52 wherein said means for extracting heat of magnetization comprises a turbine mounted in the gas stream moving into said bore wherein kinetic energy of said gas generated by said magnetic attractive forces is converted into mechanical work.

55. An apparatus as set forth in claim 52 further comprising:

compressor means mounted inside said bore for increasing the pressure of said noncondensed working fluid inside said bore;

expansion means for expanding gaseous working fluid into said condensing chamber with a sufficiently high expansion ratio so that a portion of said gaseous working fluid condenses inside said condensing chamber; and conduit means communicating with said bore and said expansion means wherein noncondensed gaseous working fluid driven out of said bore by said compresor means is introduced into said expansion means.

56. An apparatus as set forth in claim 50 wherein said superconducting magnet is constructed with a superconductor having a critical temperature above the temperature of condensed working fluid and further comprising:

heat exchanger means maintained in thermal contact with said superconductor; and conduit means for circulating condensed working fluid through said heat exchanger means thereby maintaining said superconductor below said critical temperature.

57. An apparatus as set forth in claim 48 further comprising:

a heat reservoir;

heat exchanger means maintained in thermal contact with said heat reservoir;

means for withdrawing condensed working fluid from said condensing chamber;

means for compressing condensed working fluid to an initial pressure significantly greater than the pressure inside said condensing chamber;

means for introducing compressed working fluid into said heat exchanger means whereby said working fluid is heated and vaporized to a compressed gas by absorbing thermal energy from said heat reservoir;

expander means for converting thermal energy of heated working fluid into mechanical work;

means for introducing said heated working fluid into said expander means whereby a portion of said absorbed heat energy is converted into mechanical work; and means for recycling said expanded gaseous working fluid discharged from said work generating expander means back into said condensing chamber.

58. An apparatus as set forth in claim 57 wherein said heat reservoir is the natural environment at ambient temperature.

59. An apparatus as set forth in claim 58 further comprising means for thermally insulating said condensing chamber from the ambient environment.

60. A condensing system comprising:

a working fluid that is paramagnetic; and means for reducing the entropy of said working fluid by a magnetic field operating on the working fluid.

* * * * *

UNITED STATES PATENT AND TRADEMARK OFFICE

CERTIFICATE OF CORRECTION

PATENT NO. : 5,040,373

DATED : August 20, 1991

INVENTOR(S) : Michael A. Minovitch

It is certified that error appears in the above-indentified patent and that said Letters Patent is hereby corrected as shown below:

Column 1, line 15, change $W = Q \left(\frac{T_h - T_l}{t_h}\right)$ to $W = Q \left(\frac{T_h - T_l}{t_l}\right)$ Column 8, line 62, change "$W_m$" to -- $\hat{W}_m$ --.

Column 8, line 65, change "$W_m = \frac{1}{2}MB$" to -- $\hat{W}_m = \frac{1}{2}MB$ --.

Column 8, line 67, after "symbol" insert -- ^ --.

Column 9, line 16, change "$W_c$ " to -- $\hat{W}_c$ --.

Column 9, line 22, change "$W_c$" to -- $\hat{W}_c$ --.

Column 9, line 30, change "$W_m = \frac{1}{2}MB$" to -- $\hat{W}_m = \frac{1}{2}MB$ --.

Column 9, line 38, change "$W_c$" to -- $\hat{W}_c$ --.

Column 9, line 40, change "$W_c$" to -- $\hat{W}_c$ --.

Column 9, line 41, change "$B \neq 0$, $W_c = W_c \frac{1}{2} M'B$" to -- $B \neq 0, \hat{W}_c = \hat{W}_c + \frac{1}{2} M'B$ --.

UNITED STATES PATENT AND TRADEMARK OFFICE

CERTIFICATE OF CORRECTION

PATENT NO. : 5,040,373

DATED : August 20, 1991

INVENTOR(S) : Michael A. Minovitch

It is certified that error appears in the above-identified patent and that said Letters Patent is hereby corrected as shown below:

Column 9, line 47, change "$W_m=(1-R)W_m$" to -- $W_m=(1-R)\hat{W}_m$ --.
Column 9, line 48, change "$W_c=(1-R)W_c$" to -- $W_c=(1-R)\hat{W}_c$ --.
Column 9, lines 50,51, change
"$W_{net}=W_e+W_m-W_c=W_e+\frac{1}{2}MB(1-R)-(1-R)[W_e+\frac{1}{2}M'B]=RW_e+\frac{1}{2}B(1-R)(M-M')$"
to
-- $W_{net}=\hat{W}_e+W_m-W_c=\hat{W}_e+\frac{1}{2}MB(1-R)-(1-R)[\hat{W}_e+\frac{1}{2}M'B]=R\hat{W}_e+\frac{1}{2}B(1-R)(M-M')$ --.

Column 10, line 8, change "$W_{net}=RW_e$" to -- $W_{net}=R\hat{W}_e$ --.

Column 11, line 34, change "$\mu$" to -- $\vec{\mu}$ --.
Column 11, line 36, change "dipolemoment" to
-- dipole moment --.
Column 11, line 37, change "$g\sqrt{J(J+1)}\,\mu_o$" to -- $g\sqrt{J(J+1)}\;\mu_o$ --.
Column 11, line 44, change "$\mu$" to -- $\vec{\mu}$ --.

Column 12, line 58, change "$W_e$" to -- $\hat{W}_e$ --.
Column 12, line 59, change "$W_e=H_1-H_2=173.728$" to
-- $\hat{W}_e=H_1-H_2=173.728$ --.

Column 14, line 19, change "$W_{net\,1}=11.340$" to -- $\hat{W}_{net_1}=11.340$ --.
Column 14, line 21, change "$P_1=1,000$ Bar" to
-- $P_1=1.000$ Bar --.

UNITED STATES PATENT AND TRADEMARK OFFICE

CERTIFICATE OF CORRECTION

PATENT NO. : 5,040,373

DATED : August 20, 1991

INVENTOR(S) : Michael A. Minovitch

It is certified that error appears in the above-identified patent and that said Letters Patent is hereby corrected as shown below:

Column 14, line 37, change "$W_{co}$" to -- $\hat{W}_{c_o}$ --.

Column 14, lines 51,52, change "m" to -- $\dot{m}$ -- (both occurrences).

Column 14, line 65, change "$W_{c1=H^6}-H_5=37.914$" to -- $\hat{W}_{c_1}=H_6-H_5=37.914$ --.

Column 15, line 23, change "$W_1$" to -- $\hat{W}_1$ --.

Column 15, line 30, change "$W_1=H_7-H_8=111.072$" to -- $\hat{W}_1=H_7-H_8=111.072$ --.

Column 15, line 31, change "$W_{c1}$" to -- $\hat{W}_{c_1}$ --.

Column 15, line 51, change "$W_2$" to -- $\hat{W}_2$ --.

Column 15, line 65, change "$W_2=H_9-H_{10}=153.751$" to -- $\hat{W}_2=H_9-H_{10}=153.751$ --.

Column 16, line 19, change "$W_3=H_{11}-H_{12}=54.594$" to -- $\hat{W}_3=H_{11}-H_{12}=54.594$ --.

Column 16, line 21, change "$W=W_1+W_2+W_3=319.417$" to -- $\hat{W}=\hat{W}_1+\hat{W}_2+\hat{W}_3=319.417$ --.

Column 16, line 23, change "$W_{net2}=W-W_{c1}=281.503$" to -- $\hat{W}_{net\,2}=\hat{W}-\hat{W}_{c1}=281.503$ --.

Column 16, lines 26,27, change "$W_{net\,2}=RW_{net\,2}=18.374$" to -- $W_{net_2}=RW_{net_2}=18.374$ --.

Column 16, line 28, change "$W_{net}$" to -- $\hat{W}_{net}$ --.

UNITED STATES PATENT AND TRADEMARK OFFICE

CERTIFICATE OF CORRECTION

PATENT NO. : 5,040,373

DATED : August 20, 1991

INVENTOR(S) : Michael A. Minovitch

It is certified that error appears in the above-identified patent and that said Letters Patent is hereby corrected as shown below:

Column 16, line 32, change "$W_{net}=W_{net1}+W_{net2}=29.714$ Joules/(gm expanded)" to -- $\hat{W}_{net}=W_{net_1}+W_{net_2}=29.714$ Joules/(gm expanded) --.

Column 16, line 34, change "m (gm/sec)" to -- $\dot{m}$ (gm/sec) --.

Column 16, line 37, change "$P_{net}=29.714$ m (Watt)" to --$P_{net}=29.714\ \dot{m}$ (Watt)

Column 18, line 32, change "condensdd" to -- condensed --.

Column 19, line 43, after "rate" change "m" to -- $\dot{m}$ --.

Column 20, line 58, change "$m_c$" to -- $\dot{m}_c$ --.

Column 20, line 64, change "$m_c=\sqrt{\frac{M}{T}}$" to -- $\dot{m}_c=kAP\sqrt{\frac{M}{T}}$ --.

Column 21, line 7, change "$m_c=800$ gm/sec" to -- $\dot{m}_c=800$ gm/sec --.

Column 23, line 51, change "½(1-M)B(M-M′)" to -- ½(1-R)B(M-M′) --.

UNITED STATES PATENT AND TRADEMARK OFFICE

CERTIFICATE OF CORRECTION

PATENT NO. : 5,040,373

DATED : August 20, 1991

INVENTOR(S) : Michael A. Minovitch

It is certified that error appears in the above-identified patent and that said Letters Patent is hereby corrected as shown below:

Column 24, line 43, change "m (kg/sec)" to -- $\dot{m}$ (kg/sec) --.
Column 24, line 44, change "$m=\rho A_1 u$" to -- $\dot{m}=\rho A_1 u$ --.
Column 24, line 56, change "$\rho=1/V_1=1.676$ kg/m$^3$" to
-- $\rho=1\sqrt{V_1}=1.676$ kg/m$^3$ --.

Column 25, lines 41,54, after "rate" change "m" to
-- $\dot{m}$ -- (both occurrences).

Signed and Sealed this

Fourth Day of January, 1994

*Attest:*

*Attesting Officer*

BRUCE LEHMAN

*Commissioner of Patents and Trademarks*